US010497511B2

(12) United States Patent
Sherrer

(10) Patent No.: US 10,497,511 B2
(45) Date of Patent: Dec. 3, 2019

(54) MULTILAYER BUILD PROCESSES AND DEVICES THEREOF

(71) Applicant: Nuvotronic, Inc., Radford, VA (US)

(72) Inventor: David Sherrer, Cary, NC (US)

(73) Assignee: CUBIC CORPORATION, San Diego, CA (US)

( * ) Notice: Subject to any disclaimer, the term of this patent is extended or adjusted under 35 U.S.C. 154(b) by 98 days.

(21) Appl. No.: 15/461,860

(22) Filed: Mar. 17, 2017

(65) Prior Publication Data

US 2017/0338036 A1 Nov. 23, 2017

Related U.S. Application Data

(63) Continuation of application No. 15/003,985, filed on Jan. 22, 2016, now abandoned, which is a (Continued)

(51) Int. Cl.
*H01F 41/04* (2006.01)
*C25D 5/02* (2006.01)
(Continued)

(52) U.S. Cl.
CPC ..... *H01F 41/042* (2013.01); *C25D 5/02* (2013.01); *C25D 5/022* (2013.01);
(Continued)

(58) Field of Classification Search
None
See application file for complete search history.

(56) References Cited

U.S. PATENT DOCUMENTS 2,743,505 A 5/1956 George
2,812,501 A 11/1957 Sommers
(Continued)

FOREIGN PATENT DOCUMENTS

CA 2055116 A1 5/1992
DE 3623093 A1 1/1988
(Continued)

OTHER PUBLICATIONS

Brown et al., 'A Low-Loss Ka-Band Filter in Rectangular Coax Made by Electrochemical Fabrication', submitted to Microwave and Wireless Components Letters, date unknown {downloaded from www.memgen.com, 2004). NPL_1.
(Continued)

*Primary Examiner* — Kevin M Bernatz
(74) *Attorney, Agent, or Firm* — Niels Haun; Dann, Dorfman, Herrell & Skillman

(57) ABSTRACT

A process to form devices may include forming a seed layer on and/or over a substrate, modifying a seed layer selectively, forming an image-wise mold layer on and/or over a substrate and/or electrodepositing a first material on and/or over an exposed conductive area. A process may include selectively applying a temporary patterned passivation layer on a conductive substrate, selectively forming an image-wise mold layer on and/or over a substrate, forming a first material on and/or over at least one of the exposed conductive areas and/or removing a temporary patterned passivation layer. A process may include forming a sacrificial image-wise mold layer on a substrate layer, selectively placing one or more first materials in one or more exposed portions of a substrate layer, forming one or more second materials on and/or over a substrate layer and/or removing a portion of a sacrificial image-wise mold layer.

20 Claims, 27 Drawing Sheets

Figure 1A:
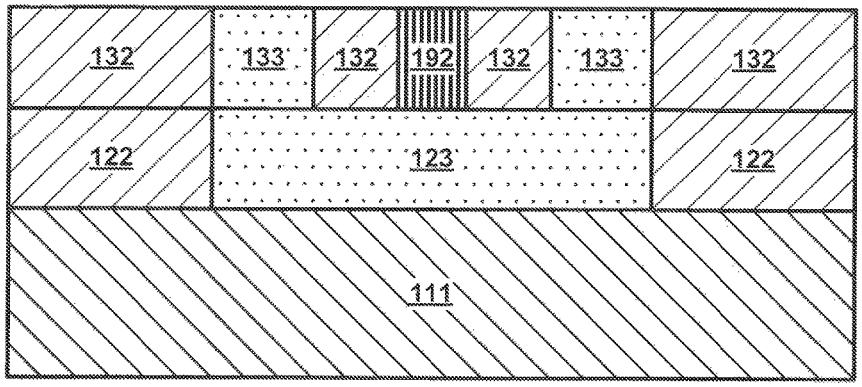

Related U.S. Application Data continuation of application No. 13/965,524, filed on Aug. 13, 2013, now abandoned, which is a continuation of application No. 12/953,393, filed on Nov. 23, 2010, now abandoned.

(60) Provisional application No. 61/263,777, filed on Nov. 23, 2009.

(51) Int. Cl.

| | |
|---|---|
| ***H01F 41/14*** | (2006.01) |
| ***H01F 27/28*** | (2006.01) |
| *C25D 5/12* | (2006.01) |
| *C25D 5/18* | (2006.01) |

(52) U.S. Cl.

CPC ..... *H01F 27/2804* (2013.01); *H01F 41/14* (2013.01); *C25D 5/12* (2013.01); *C25D 5/18* (2013.01); *Y10T 156/10* (2015.01); *Y10T 428/24802* (2015.01)

(56) References Cited

U.S. PATENT DOCUMENTS

| | | | |
|---|---|---|---|
| 2,914,766 | A | 11/1959 | Butler |
| 2,997,519 | A | 8/1961 | Hines |
| 3,157,847 | A | 11/1964 | Williams |
| 3,517,847 | A | 11/1964 | Williams |
| 3,309,632 | A | 3/1967 | Trudeau |
| 3,311,966 | A | 4/1967 | Henry |
| 3,335,489 | A | 8/1967 | Grant |
| 3,352,730 | A | 11/1967 | Murch |
| 3,464,855 | A | 9/1969 | Quintana |
| 3,526,867 | A | 9/1970 | Keeler |
| 3,537,043 | A | 10/1970 | Smith |
| 3,560,896 | A | 2/1971 | Essinger |
| 3,577,105 | A | 5/1971 | Jones, Jr. |
| 3,598,107 | A | 8/1971 | Ishikawa |
| 3,760,306 | A | 9/1973 | Spinner |
| 3,775,844 | A | 12/1973 | Parks |
| 3,789,129 | A | 1/1974 | Ditscheid |
| 3,791,858 | A | 2/1974 | McPherson |
| 3,884,549 | A | 5/1975 | Wang |
| 3,925,883 | A | 12/1975 | Cavalear |
| 3,963,999 | A | 6/1976 | Nakajima |
| 4,021,789 | A | 5/1977 | Furman |
| 4,033,656 | A | 7/1977 | Freehauf |
| 4,075,757 | A | 2/1978 | Malm |
| 4,275,944 | A | 6/1981 | Sochor |
| 4,348,253 | A | 9/1982 | Subbarao |
| 4,365,222 | A | 12/1982 | Lampert |
| 4,414,424 | A | 11/1983 | Mizoguchi |
| 4,417,393 | A | 11/1983 | Becker |
| 4,437,074 | A | 3/1984 | Cohen |
| 4,521,755 | A | 6/1985 | Carlson |
| 4,539,534 | A | 9/1985 | Hudspeth |
| 4,581,301 | A | 4/1986 | Michaelson |
| 4,591,411 | A | 5/1986 | Reimann |
| 4,641,140 | A | 2/1987 | Heckaman |
| 4,647,878 | A | 3/1987 | Landis |
| 4,663,497 | A | 5/1987 | Reimann |
| 4,673,904 | A | 6/1987 | Landis |
| 4,677,393 | A | 6/1987 | Sharma |
| 4,684,181 | A | 8/1987 | Massit |
| 4,700,159 | A | 10/1987 | Jones |
| 4,717,064 | A | 1/1988 | Popielarski |
| 4,729,510 | A | 3/1988 | Landis |
| 4,771,294 | A | 9/1988 | Wasilousky |
| 4,808,273 | A | 2/1989 | Hua |
| 4,832,461 | A | 5/1989 | Yamagishi |
| 4,853,656 | A | 8/1989 | Guillou |
| 4,856,184 | A | 8/1989 | Doeling |
| 4,857,418 | A | 8/1989 | Schuetz |
| 4,859,806 | A | 8/1989 | Smith |
| 4,876,322 | A | 10/1989 | Budde |
| 4,880,684 | A | 11/1989 | Boss |
| 4,909,909 | A | 3/1990 | Florjancic |
| 4,915,983 | A | 4/1990 | Lake |
| 4,969,979 | A | 11/1990 | Appelt |
| 4,975,142 | A | 12/1990 | Iannacone |
| 5,069,749 | A | 12/1991 | Gutierrez |
| 5,072,201 | A | 12/1991 | Devaux |
| 5,089,880 | A | 2/1992 | Meyer |
| 5,100,501 | A | 3/1992 | Blumenthal |
| 5,119,049 | A | 6/1992 | Heller |
| 5,191,699 | A | 3/1993 | Ganslmeier |
| 5,213,511 | A | 5/1993 | Sobhani |
| 5,227,013 | A | 7/1993 | Kumar |
| 5,235,208 | A | 8/1993 | Katoh |
| 5,274,484 | A | 12/1993 | Mochizuki |
| 5,299,939 | A | 4/1994 | Walker |
| 5,312,456 | A | 5/1994 | Reed |
| 5,334,956 | A | 8/1994 | Leding |
| 5,381,157 | A | 1/1995 | Shiga |
| 5,381,596 | A | 1/1995 | Ferro |
| 5,406,235 | A | 4/1995 | Hayashi |
| 5,406,423 | A | 4/1995 | Hayashi |
| 5,430,257 | A | 7/1995 | Lau |
| 5,454,161 | A | 10/1995 | Beilin |
| 5,529,504 | A | 6/1996 | Greenstein |
| 5,622,895 | A | 4/1997 | Frank |
| 5,633,615 | A | 5/1997 | Quan |
| 5,682,062 | A | 10/1997 | Gaul |
| 5,682,124 | A | 10/1997 | Suski |
| 5,712,607 | A | 1/1998 | Dittmer |
| 5,724,012 | A | 3/1998 | Teunisse |
| 5,746,868 | A | 5/1998 | Abe |
| 5,793,272 | A | 8/1998 | Burghartz |
| 5,814,889 | A | 9/1998 | Gaul |
| 5,860,812 | A | 1/1999 | Gugliotti |
| 5,872,399 | A | 2/1999 | Lee |
| 5,903,059 | A | 5/1999 | Bertin |
| 5,925,206 | A | 7/1999 | Boyko |
| 5,940,674 | A | 8/1999 | Sachs |
| 5,961,347 | A | 10/1999 | Hsu |
| 5,977,842 | A | 11/1999 | Brown |
| 5,990,768 | A | 11/1999 | Takahashi |
| 6,008,102 | A | 12/1999 | Alford |
| 6,027,630 | A | 2/2000 | Cohen |
| 6,054,252 | A | 4/2000 | Lundy |
| 6,101,705 | A | 8/2000 | Wolfson |
| 6,180,261 | B1 | 1/2001 | Inoue |
| 6,183,268 | B1 | 2/2001 | Consoli |
| 6,207,901 | B1 | 3/2001 | Smith |
| 6,210,221 | B1 | 4/2001 | Maury |
| 6,228,466 | B1 | 5/2001 | Tsukada |
| 6,232,669 | B1 | 5/2001 | Khoury |
| 6,294,965 | B1 | 9/2001 | Merrill |
| 6,329,605 | B1 | 12/2001 | Beroz |
| 6,350,633 | B1 | 2/2002 | Lin |
| 6,388,198 | B1 | 5/2002 | Bertin |
| 6,457,979 | B1 | 10/2002 | Dove |
| 6,465,747 | B2 | 10/2002 | DiStefano |
| 6,466,112 | B1 | 10/2002 | Kwon |
| 6,514,845 | B1 | 2/2003 | Eng |
| 6,518,165 | B1 | 2/2003 | Yoon |
| 6,535,088 | B1 | 3/2003 | Sherman |
| 6,538,312 | B1 | 3/2003 | Peterson |
| 6,589,594 | B1 | 7/2003 | Hembree |
| 6,600,395 | B1 | 7/2003 | Handforth |
| 6,603,376 | B1 | 8/2003 | Handforth |
| 6,648,653 | B2 | 11/2003 | Huang |
| 6,662,443 | B2 | 12/2003 | Chou |
| 6,677,248 | B2 | 1/2004 | Kwon |
| 6,735,009 | B2 | 5/2004 | Li |
| 6,746,891 | B2 | 6/2004 | Cunningham |
| 6,749,737 | B2 | 6/2004 | Cheng |
| 6,800,360 | B2 | 10/2004 | Miyanaga |
| 6,800,555 | B2 | 10/2004 | Test |
| 6,827,608 | B2 | 12/2004 | Hall |
| 6,850,084 | B2 | 2/2005 | Hembree |
| 6,868,214 | B1 | 3/2005 | Sakata |
| 6,888,427 | B2 | 5/2005 | Sinsheimer |
| 6,889,433 | B1 | 5/2005 | Enomoto |

(56) References Cited

U.S. PATENT DOCUMENTS 6,914,513 B1 7/2005 Wahlers
6,917,086 B2 7/2005 Cunningham
6,943,452 B2 9/2005 Bertin
6,971,913 B1 12/2005 Chu
6,975,267 B2 12/2005 Stenger
6,981,414 B2 1/2006 Knowles
7,005,750 B2 2/2006 Liu
7,012,489 B2 3/2006 Sherrer
7,030,712 B2 4/2006 Brunette
7,064,449 B2 6/2006 Lin
7,077,697 B2 7/2006 Kooiman
7,084,722 B2 8/2006 Goyette
D530,674 S 10/2006 Ko
7,116,190 B2 10/2006 Brunker
7,129,163 B2 10/2006 Sherrer
7,148,141 B2 12/2006 Shim
7,148,722 B1 12/2006 Cliff
7,148,772 B2 12/2006 Sherrer
7,165,974 B2 1/2007 Kooiman
7,217,156 B2 5/2007 Wang
7,222,420 B2 5/2007 Moriizumi
7,239,219 B2 7/2007 Brown
7,252,861 B2 8/2007 Smalley
7,259,640 B2 8/2007 Brown
7,383,632 B2 6/2008 Dittmann
7,388,388 B2 6/2008 Dong
7,400,222 B2 7/2008 Kwon
7,405,638 B2 7/2008 Sherrer
7,449,784 B2 11/2008 Sherrer
7,478,475 B2 1/2009 Hall
7,508,065 B2 3/2009 Sherrer
7,532,163 B2 5/2009 Chang
7,555,309 B2 6/2009 Baldor
7,575,474 B1 8/2009 Dodson
7,579,553 B2 8/2009 Moriizumi
7,602,059 B2 10/2009 Nobutaka
7,619,441 B1 11/2009 Rahman
7,628,617 B2 12/2009 Brown
7,645,147 B2 1/2010 Dittmann
7,645,940 B2 1/2010 Shepherd
7,649,432 B2 1/2010 Sherrer
7,656,256 B2 2/2010 Houck
7,658,831 B2 2/2010 Mathieu
7,683,842 B1 3/2010 Engel
7,705,456 B2 4/2010 Hu
7,741,853 B2 6/2010 Blakely
7,755,174 B2 7/2010 Rollin
7,898,356 B2 3/2011 Sherrer
7,948,335 B2 5/2011 Sherrer
8,011,959 B1 9/2011 Tsai
8,031,037 B2 10/2011 Sherrer
8,188,932 B2 5/2012 Worl
8,264,297 B2 9/2012 Thompson
8,304,666 B2 11/2012 Ko
8,339,232 B2 12/2012 Lotfi
8,441,118 B2 5/2013 Hua
8,522,430 B2 9/2013 Kacker
8,542,079 B2 9/2013 Sherrer
8,641,428 B2 2/2014 Light
8,674,872 B2 3/2014 Billaud
8,742,874 B2 6/2014 Sherrer
8,814,601 B1 8/2014 Sherrer
8,866,300 B1 10/2014 Sherrer
8,888,504 B2 11/2014 Pischler
9,000,863 B2 4/2015 Sherrer
9,306,254 B1 4/2016 Hovey
9,325,044 B2 4/2016 Reid
9,505,613 B2 11/2016 Sherrer
9,536,843 B2 1/2017 Takagi
9,583,856 B2 2/2017 Sherrer
9,633,976 B1 4/2017 Bernstein
9,786,975 B2 10/2017 Kocurek
9,888,600 B2 2/2018 Hovey
10,193,203 B2 * 1/2019 Rollin ..... H01P 3/06
10,254,499 B1 * 4/2019 Cohen ..... G02B 6/4463
2001/0040051 A1 11/2001 Lipponen
2001/0045361 A1 11/2001 Boone
2002/0074565 A1 6/2002 Flagan
2002/0075104 A1 6/2002 Kwon
2002/0127768 A1 9/2002 Badir
2003/0029729 A1 2/2003 Cheng
2003/0052755 A1 3/2003 Barnes
2003/0117237 A1 6/2003 Niu
2003/0221968 A1 12/2003 Cohen
2003/0222738 A1 12/2003 Brown
2004/0000701 A1 1/2004 White
2004/0004061 A1 1/2004 Merdan
2004/0007468 A1 1/2004 Cohen
2004/0007470 A1 1/2004 Smalley
2004/0038586 A1 2/2004 Hall
2004/0076806 A1 4/2004 Miyanaga
2004/0124961 A1 * 7/2004 Aoyagi ..... H01F 17/0033 336/200
2004/0196112 A1 10/2004 Welbon
2004/0263290 A1 12/2004 Sherrer
2005/0013977 A1 1/2005 Wong
2005/0030124 A1 2/2005 Okamoto
2005/0042932 A1 2/2005 Mok
2005/0045484 A1 3/2005 Smalley
2005/0156693 A1 7/2005 Dove
2005/0230145 A1 10/2005 Ishii
2005/0250253 A1 11/2005 Cheung
2008/0191817 A1 8/2008 Sherrer
2008/0197946 A1 8/2008 Houck
2008/0199656 A1 8/2008 Nichols
2008/0240656 A1 10/2008 Rollin
2009/0004385 A1 1/2009 Blackwell
2009/0051476 A1 2/2009 Tada
2009/0154972 A1 6/2009 Tanaka
2010/0007016 A1 1/2010 Oppermann
2010/0015850 A1 1/2010 Stein
2010/0109819 A1 5/2010 Houck
2010/0225435 A1 9/2010 Li
2010/0296252 A1 11/2010 Rollin
2010/0323551 A1 12/2010 Eldridge
2011/0123783 A1 5/2011 Sherrer
2011/0123794 A1 5/2011 Hiller
2011/0181376 A1 7/2011 Vanhille
2011/0181377 A1 7/2011 Vanhille
2011/0210807 A1 9/2011 Sherrer
2011/0273241 A1 11/2011 Sherrer
2012/0182703 A1 7/2012 Rendek, Jr.
2012/0233849 A1 9/2012 Smeys
2013/0050055 A1 2/2013 Paradiso
2013/0127577 A1 5/2013 Lotfi
2016/0054385 A1 2/2016 Suto
2018/0333914 A1 * 11/2018 Rudisill ..... C09D 1/00
2019/0214179 A1 * 7/2019 Pyrhonen ..... H01F 27/245

FOREIGN PATENT DOCUMENTS

EP 0398019 A1 11/1990
EP 0485831 A1 5/1992
EP 0845831 A2 6/1998
EP 0911903 A2 4/1999
FR 2086327 A1 12/1971
GB 2265754 10/1993
JP H027587 A 1/1990
JP 3027587 2/1991
JP H041710 A 1/1992
JP H0685510 A 3/1994
JP H06302964 A 10/1994
JP H07060844 3/1995
JP H07235803 9/1995
JP H10041710 2/1998
JP 1998163711 6/1998
JP 2002533954 10/2002
JP 2003032007 1/2003
JP 2003249731 9/2003
JP 200667621 3/2006
JP 2007253354 10/2007
JP 2008211159 9/2008
JP 2008283012 11/2008
JP 2008307737 12/2008

(56) References Cited

FOREIGN PATENT DOCUMENTS

| | | | |
|---|---|---|---|
| TW | I244799 | | 12/2005 |
| WO | 0007218 | A2 | 2/2000 |
| WO | 0039854 | A1 | 7/2000 |
| WO | 0206152 | A2 | 1/2002 |
| WO | 02080279 | A1 | 10/2002 |
| WO | 2004004061 | | 1/2004 |
| WO | 2005112105 | | 11/2005 |
| WO | 2009013751 | A2 | 1/2009 |
| WO | 2010111455 | | 9/2010 |

OTHER PUBLICATIONS

Chwomnawang et al., 'On-chip 3D Air Core Micro-Inductor for High-Frequency Applications Using Deformation of Sacrificial Polymer', Proc. SPIE, vol. 4334, pp. 54-62, Mar. 2001. NPL_2.
Elliott Brown/MEMGen Corporation, 'RF Applications of EFAB Technology', MTT-S IMS 2003, pp. 1-15. NPL_6.
Engelmann et al., 'Fabrication of High Depth-to-Width Aspect Ratio Microstructures', IEEE Micro Electro Mechanical Systems (Feb. 1992), pp. 93-98.
European Search Report of Corresponding European Application No. 07 15 0467 dated Apr. 28, 2008.
Frazier et al., 'M ET ALlic Microstructures Fabricated Using Photosensitive Polyimide Electroplating Molds', Journal of Microelectromechanical Systems, vol. 2, No. 2, Jun. 1993, pp. 87-94. NPL_8.
H. Guckel, 'High-Aspect-Ratio Micromachining Via Deep X-Ray Lithography', Proc. of IEEE, vol. 86, No. 8 (Aug. 1998), pp. 1586-1593. NPL_10.
Katehi et al., 'MEMS and Si Micromachined Circuits for High-Frequency Applications', IEEE Transactions on Microwave Theory and Techniques, vol. 50, No. 3, Mar. 2002, pp. 858-866. NPL_13.
Lee et al., 'Micromachining Applications of a High Resolution Ultrathick Photoresist', J. Vac. Sci. Technol. B 13 (6), Nov./Dec. 1995, pp. 3012-3016. NPL_15.
Loechel et al., 'Application of Ultraviolet Depth Lithography for Surface Micromachining', J. Vac. Sci. Technol. B 13 (6), Nov./Dec. 1995, pp. 2934-2939. NPL_16.
Park et al., 'Electroplated Micro-Inductors and Micro-Transformers for Wireless application', IMAPS 2002, Denver, CO, Sep. 2002. NPL_18.
Tummala et al.; 'Microelectronics Packaging Handbook'; Jan. 1, 1989; XP002477031; pp. 710-714. NPL_31.
Yoon et al., '3-D Lithography and M ET AL Surface Micromachining for RF and Microwave MEMs' IEEE MEMS 2002 Conference, Las Vegas, NV, Jan. 2002, pp. 673-676. NPL_21.
Yoon et al., 'CMOS-Compatible Surface Micromachined Suspended-Spiral Inductors for Multi-GHz Sillicon RF Ics', IEEE Electron Device Letters, vol. 23, No. 10, Oct. 2002, pp. 591-593. NPL_22.
Yoon et al., 'High-Performance Electroplated Solenoid-Type Integrated Inductor (SI2) for RF Applications Using Simple 3D Surface Micromachining Technology', Int'l Election Devices Meeting, 1998, San Francisco, CA, Dec. 6-9, 1998, pp. 544-547. NPL_23.
Yoon et al., 'High-Performance Three-Dimensional On-Chip Inductors Fabricated by Novel Micromachining Technology for RF MMIC', 1999 IEEE MTT-S Int'l Microwave Symposium Digest, vol. 4, Jun. 13-19, 1999, Anaheim, California, pp. 1523-1526. NPL_24.
Yoon et al., 'Monolithic High-Q Overhang Inductors Fabricated on Silicon and Glass Substrates', International Electron Devices Meeting, Washington D.C. (Dec. 1999), pp. 753-756. NPL_25.
Yoon et al., 'Monolithic Integration of 3-D Electroplated Microstructures with Unlimited Number of Levels Using Planarization with a Sacrificial M ET ALlic Mole (PSMm)', Twelfth IEEE Int'l Conf. on Micro Electro mechanical systems, Orlando Florida, Jan. 1999, pp. 624-629. NPL_26.
Yoon et al., 'Multilevel Microstructure Fabrication Using Single-Step 3D Photolithography and Single-Step Electroplating', Proc. of SPIE, vol. 3512, (Sep. 1998), pp. 358-366. NPL_27.
Filipovic et al.; 'Modeling, Design, Fabrication, and Performance of Rectangular .mu.-Coaxial Lines and Components'; Microwave Symposium Digest, 2006, IEEE; Jun. 1, 2006; pp. 1393-1396.
European Search Report of corresponding European Application No. 08 15 3138 dated Jul. 15, 2008.
Ali Darwish et al.; Vertical Balun and Wilkinson Divider; 2002 IEEE MTT-S Digest; pp. 109-112. NPL_30.
Cole, B.E., et al., Micromachined Pixel Arrays Integrated with CMOS for Infrared Applications, pp. 64-64 (2000). NPL_3.
De Los Santos, H.J., Introduction to Microelectromechanical (MEM) Microwave Systems {pp. 4, 7-8, 13) (1999). NPL_4.
Deyong, C, et al., A Microstructure Semiconductor Thermocouple for Microwave Power Sensors, 1997 Asia Pacific Microwave Conference, pp. 917-919. NPL_5.
Franssila, S., Introduction to Microfabrication, (pp. 8) (2004). NPL_7.
Ghodisian, B., et al., Fabrication of Affordable M ET ALlic Microstructures by Electroplating and Photoresist Molds, 1996, pp. 68-71. NPL_9.
Hawkins, C.F., The Microelectronics Failure Analysis, Desk Reference Edition (2004). NPL_11.
Jeong, Inho et al., 'High-Performance Air-Gap Transmission Lines and Inductors for Millimeter-Wave Applications', IEEE Transactions on Microwave Theory and Techniques, Dec. 2002, pp. 2850-2855, vol. 50, No. 12. NPL_12.
Kenneth J. Vanhille et al.; Micro-Coaxial Imedance Transformers; Journal of Latex Class Files; vol. 6; No. 1; Jan. 2007. NPL_29.
Kwok, P.Y., et al., Fluid Effects in Vibrating Micromachined Structures, Journal of Microelectromechanical Systems, vol. 14, No. 4, Aug. 2005, pp. 770-781. NPL_14.
Madou, M.J., Fundamentals of Microfabrication: The Science of Miniaturization, 2d Ed., 2002 (Roadmap; pp. 615-668). NPL_17.
Sedky, S., Post-Processing Techniques for Integrated MEMS (pp. 9, 11, 164) (2006). NPL_19.
Yeh, J.L., et al., Copper-Encapsulated Silicon Micromachined Structures, Journal of Microelectromechanical Systems, vol. 9, No. 3, Sep. 2000, pp. 281-287. NPL_20.
Chance, G.I. et al., "A suspended-membrane balanced frequency doubler at 200GHz," 29th International Conference on Infrared and Millimeter Waves and Terahertz Electronics, pp. 321-322, Karlsrube, 2004.
Colantonio, P., et al., "High Efficiency RF and Microwave Solid State Power Amplifiers," pp. 380-395, 2009.
Ehsan, N., "Broadband Microwave Litographic 3D Components," Doctoral Dissertation 2010.
Ehsan, N. et al., "Microcoaxial lines for active hybrid-monolithic circuits," 2009 IEEE MTT-S Int. Microwave.Symp. Boston, MA, Jun. 2009.
European Examination Report dated Mar. 21, 2013 for EP Application No. 07150463.3.
European Examination Report of corresponding European Patent Application No. 08 15 3144 dated Apr. 6, 2010.
European Examination Report of corresponding European Patent Application No. 08 15 3144 dated Feb. 22, 2012.
European Examination Report of corresponding European Patent Application No. 08 15 3144 dated Nov. 10, 2008.
European Search Report for corresponding EP Application No. 07150463.3 dated Apr. 23, 2012.
European Search Report of corresponding European Patent Application No. 08 15 3144 dated Jul. 2, 2008.
Filipovic, D. et al., "Monolithic rectangular coaxial lines. Components and systems for commercial and defense applications," Presented at 2008 IASTED Antennas, Radar, and Wave Propagation Conferences, Baltimore, MD, USA, Apr. 2008.
Filipovic, D.S., "Design of microfabricated rectangular coaxial lines and components for mm-wave applications," Microwave Review, vol. 12, No. 2, Nov. 2006, pp. 11-16.
Immorlica, Jr., T. et al., "Miniature 3D micro-machined solid state power amplifiers," COMCAS 2008.
Ingram, D.L. et al., "A 427 mW 20% compact W-band InP HEMT MMIC power amplifier," IEEE RFIC Symp. Digest 1999, pp. 95-98.

(56) References Cited

OTHER PUBLICATIONS

International Preliminary Report on Patentability dated Jul. 24,2012 for corresponding PCT/US2011/022173.
International Preliminary Report on Patentability dated May 19, 2006 on corresponding PCT/US04/06665.
Jeong, I., et al., "High Performance Air-Gap Transmission Lines and Inductors for Milimeter-Wave Applications", Transactions on Microwave Theory and Techniques, vol. 50, No. 12, Dec. 2002.
Lukic, M. et al., "Surface-micromachined dual Ka-band cavity backed patch antennas," IEEE Trans. AtennasPropag., vol. 55, pp. 2107-2110, Jul. 2007.
Oliver, J.M. et al., "A 3-D micromachined W-band cavity backed patch antenna array with integrated rectacoax transition to wave guide," 2009 Proc. IEEE International Microwave Symposium, Boston, MA 2009.
PwrSoC Update 2012: Technology, Challenges, and Opportunities for Power Supply on Chip, Presentation (Mar. 18, 2013).
Rollin, J.M. et al., "A membrane planar diode for 200GHz mixing applications," 29th International Conference on Infrared and Millimeter Waves and Terahertz Electronics, pp. 205-206, Karlsrube, 2004.
Rollin, J.M. et al., "Integrated Schottky diode for a sub-harmonic mixer at millimetre wavelengths," 31st International Conference on Infrared and Millimeter Waves and Terahertz Electronics, Paris, 2006.
Saito, Y., Fontaine, D., Rollin, J-M., Filipovic, D., 'Micro-Coaxial Ka-Band Gysel Power Dividers,' Microwave Opt Technol Lett 52: 474-478, 2010, Feb. 2010.
Saito et al., "Analysis and design of monolithic rectangular coaxial lines for minimum coupling," IEEE Trans. Microwave Theory Tech., vol. 55, pp. 2521-2530, Dec. 2007.
Sherrer, D, Vanhille, K, Rollin, J.M., 'PolyStrata Technology: A Disruptive Approach for 3D Microwave Components and Modules,' Presentation (Apr. 23, 2010).
Vanhille, K., 'Design and Characterization of Microfabricated Three-Dimensional Millimeter-Wave Components,' Dissertation, 2007.
Vanhille, K. et al., 'Balanced low-loss Ka-band—coaxial hybrids,' IEEE MTT-S Dig., Honolulu, Hawaii, Jun. 2007.
Vanhille, K. et al., "Ka-Band surface mount directional coupler fabricated using micro-rectangular coaxial transmission lines," 2008 Proc. IEEE International Microwave Symposium, 2008.
Vanhille, K.J. et al., "Ka-band miniaturized quasi-planar high-Q resonators," IEEE Trans. Microwave Theory Tech., vol. 55, No. 6, pp. 1272-1279, Jun. 2007.
Vyas R. et al., "Liquid Crystal Polymer (LCP): The ultimate solution for low-cost RF flexible electronics and antennas," Antennas and Propagation Society, International Symposium, p. 1729-1732 (2007).
Wang, H. et al., "Design of a low integrated sub-harmonic mixer at 183GHz using European Schottky diode technology," From Proceedings of the 4th ESA workshop on Millimetre-Wave Technology and Applications, pp. 249-252, Espoo, Finland, Feb. 2006.
Wang, H. et al., "Power-amplifier modules covering 70-113 GHz using MMICs," IEEE Trans Microwave Theory and Tech., vol. 39, pp. 9-16, Jan. 2001.
Written Opinion of the International Searching Authority dated Aug. 29, 2005 on corresponding PCT/US04/06665.
"Multiplexer/LNA Module using PolyStrata®," GOMACTech-15, Mar. 26, 2015.
"Shiffman phase shifters designed to work over a 15-45GHz range," phys.org, Mar. 2014. [online: http://phys.org/wire-news/156496085/schiffman-phase-shifters-designed-to-work-over-a-15-45ghz-range.html].
A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.
A. Boryssenko, K. Vanhille, "300-GHz microfabricated waveguide slotted arrays" 2014 IEEE International Conference on Infrared, Millimeter, and Terahertz Waves, Tucson, Sep. 2014.
A.A. Immorlica Jr., R. Actis, D. Nair, K. Vanhille, C. Nichols, J.-M. Rollin, D. Fleming, R. Varghese, D. Sherrer, D. Filipovic, E. Cullens, N. Ehsan, and Z. Popovic, "Miniature 3D micromachined solid state amplifiers," in 2008 IEEE International Conference on Microwaves, Communications, Antennas, and Electronic Systems, Tel-Aviv, Israel, May 2008, pp. 1-7.
B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.
D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.
D. Filipovic, G. Potvin, D. Fontaine, Y. Saito, J.-M. Rollin, Z. Popovic, M. Lukic, K. Vanhille, C. Nichols, "Ã?Âμ-coaxial phased arrays for Ka-Band Communications," Antenna Applications Symposium, Monticello, IL, Sep. 2008, pp. 104-115.
D. Filipovic, Z. Popovic, K. Vanhille, M. Lukic, S. Rondineau, M. Buck, G. Potvin, D. Fontaine, C. Nichols, D. Sherrer, S. Zhou, W. Houck, D. Fleming, E. Daniel, W. Wilkins, V. Sokolov, E. Adler, and J. Evans, "Quasi-planar rectangular μ-coaxial structures for mm-wave applications," Proc. GomacTech., pp. 28-31, San Diego, Mar. 2006.
D. Sherrer, "Improving electronics' functional density," MICROmanufacturing, May/Jun. 2015, pp. 16-18.
D.S. Filipovic, M. Lukic, Y. Lee and D. Fontaine, "Monolithic rectangular coaxial lines and resonators with embedded dielectric support," IEEE Microwave and Wireless Components Letters, vol. 18, No. 11, pp. 740-742, 2008.
E. Cullens, "Microfabricated Broadband Components for Microwave Front Ends," Thesis, 2011.
E. Cullens, K. Vanhille, Z. Popovic, "Miniature bias-tee networks integrated in microcoaxial lines," in Proc. 40th European Microwave Conf., Paris, France, Sep. 2010, pp. 413-416.
E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.
E. Cullens, L. Ranzani, K. Vanhille, E. Grossman, N. Ehsan, Z. Popovic, "Micro-Fabricated 130-180 GHz frequency scanning waveguide arrays," IEEE Trans. Antennas Propag., Aug. 2012, vol. 60, No. 8, pp. 3647-3653.
European Examination Report of EP App. No. 07150463.3 dated Feb. 16, 2015.
Extended EP Search Report for EP Application No. 12811132.5 dated Feb. 5, 2016.
H. Kazemi, "350mW G-band Medium Power Amplifier Fabricated Through a New Method of 3D-Copper Additive Manufacturing," IEEE 2015.
H. Kazemi, "Ultra-compact G-band 16way Power Splitter/Combiner Module Fabricated Through a New Method of 3D-Copper Additive Manufacturing," IEEE 2015.
H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.
H. Zhou, N. A. Sutton, D. S. Filipovic, "Wideband W-band patch antenna," 5th European Conference on Antennas and Propagation , Rome, Italy, Apr. 2011, pp. 1518-1521.
H. Zhou, N.A. Sutton, D. S. Filipovic, "W-band endfire log periodic dipole array," Proc. IEEE-APS/URSI Symposium, Spokane, WA, Jul. 2011, pp. 1233-1236.
Horton, M.C., et al., "The Digital Elliptic Filter—A Compact Sharp-Cutoff Design for Wide Bandstop or Bandpass Requirements," IEEE Transactions on Microwave Theory and Techniques, (1967) MTT-15:307-314.
International Search Report and Written Opinion for PCT/US2015/063192 dated May 20, 2016.
International Search Report corresponding to PCT/US12/46734 dated Nov. 20, 2012.
J. M. Oliver, J.-M. Rollin, K. Vanhille, S. Raman, "A W-band micromachined 3-D cavity-backed patch antenna array with inte-

(56) References Cited

OTHER PUBLICATIONS grated diode detector," IEEE Trans. Microwave Theory Tech., Feb. 2012, vol. 60, No. 2, pp. 284-292.
J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.
J. Mruk, "Wideband Monolithically Integrated Front-End Subsystems and Components," Thesis, 2011.
J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.
J. Oliver, "3D Micromachined Passive Components and Active Circuit Integration for Millimeter-Wave Radar Applications," Thesis, Feb. 10, 2011.
J. R. Mruk, H. Zhou, H. Levitt, D. Filipovic, "Dual wideband monolithically integrated millimeter-wave passive front-end subsystems," in 2010 Int. Conf. on Infrared, Millimeter and Terahertz Waves , Sep. 2010, pp. 1-2.
J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.
J. Reid, "PolyStrata Millimeter-wave Tunable Filters," GOMACTech-12, Mar. 22, 2012.
J.M. Oliver, H. Kazemi, J.-M. Rollin, D. Sherrer, S. Huettner, S. Raman, "Compact, low-loss, micromachined rectangular coaxial millimeter-wave power combining networks," 2013 IEEE MTT-S Int. Microwave, Symp., Seattle, WA, Jun. 2013.
J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.
J.R. Reid, D. Hanna, R.T. Webster, "A 40/50 GHz diplexer realized with three dimensional copper micromachining," in 2008 IEEE MTT-S Int. Microwave Symp., Atlanta, GA, Jun. 2008, pp. 1271-1274.
J.R. Reid, J.M. Oliver, K. Vanhille, D. Sherrer, "Three dimensional metal micromachining: A disruptive technology for millimeter-wave filters," 2012 IEEE Topical Meeting on Silicon Monolithic Integrated Circuits in RF Systems, Jan. 2012.
K. J. Vanhille, D. L. Fontaine, C. Nichols, D. S. Filipovic, and Z. Popovic, "Quasi-planar high-Q millimeter-wave resonators," IEEE Trans. Microwave Theory Tech., vol. 54, No. 6, pp. 2439-2446, Jun. 2006.
K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.
K. Vanhille, "Design and Characterization of Microfabricated Three-Dimensional Millimeter-Wave Components," Thesis, 2007.
K. Vanhille, M. Buck, Z. Popovic, and D.S. Filipovic, "Miniature Ka-band recta-coax components: analysis and design," presented at 2005 AP-S/URSI Symposium, Washington, DC, Jul. 2005.
K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.
K. Vanhille, T. Durham, W. Stacy, D. Karasiewicz, A. Caba, C. Trent, K. Lambert, F. Miranda, "A microfabricated 8-40 GHz dual-polarized reflector feed," 2014 Antenna Applications Symposium, Monticello, IL, Sep. 2014. pp. 241-257.
L. Ranzani, D. Kuester, K. J. Vanhille, A Boryssenko, E. Grossman, Z. Popovic, "G-Band micro-fabricated frequency-steered arrays with 2Â?Â°/GHz beam steering," IEEE Trans. on Terahertz Science and Technology, vol. 3, No. 5, Sep. 2013.
L. Ranzani, E. D. Cullens, D. Kuester, K. J. Vanhille, E. Grossman, Z. Popovic, "W-band micro-fabricated coaxially-fed frequency scanned slot arrays," IEEE Trans. Antennas Propag., vol. 61, No. 4, Apr. 2013.
L. Ranzani, I. Ramos, Z. Popovic, D. Maksimovic, "Microfabricated transmission-line transformers with DC isolation," URSI National Radio Science Meeting, Boulder, CO, Jan. 2014.
L. Ranzani, N. Ehsan, Z. Popovic, "G-band frequency-scanned antenna arrays," 2010 IEEE APS-URSI International Symposium, Toronto, Canada, Jul. 2010.
M. Lukic, D. Filipovic, "Modeling of surface roughness effects on the performance of rectangular Ã?Âµ-coaxial lines," Proc. 22nd Ann. Rev. Prog. Applied Comp. Electromag. (ACES), pp. 620-625, Miami, Mar. 2006.
M. Lukic, D. Fontaine, C. Nichols, D. Filipovic, "Surface micromachined Ka-band phased array antenna," Presented at Antenna Applic. Symposium, Monticello, IL, Sep. 2006.
M. Lukic, K. Kim, Y. Lee, Y. Saito, and D. S. Filipovic, "Multi-physics design and performance of a surface micromachined Ka-band cavity backed patch antenna," 2007 SBMO/IEEE Int. Microwave and Optoelectronics Conf., Oct. 2007, pp. 321-324.
M. Lukic, S. Rondineau, Z. Popovic, D. Filipovic, "Modeling of realistic rectangular Ã?Âµ-coaxial lines," IEEE Trans. Microwave Theory Tech., vol. 54, No. 5, pp. 2068-2076, May 2006.
M. V. Lukic, and D. S. Filipovic, "Integrated cavity-backed ka-band phased array antenna," Proc. IEEE-APS/URSI Symposium, Jun. 2007, pp. 133-135.
M. V. Lukic, and D. S. Filipovic, "Modeling of 3-D Surface Roughness Effects With Application to Ã?Âµ-Coaxial Lines," IEEE Trans. Microwave Theory Tech., Mar. 2007, pp. 518-525.
M. V. Lukic, and D. S. Filipovic, "Surface-micromachined dual Ka-and cavity backed patch antenna," IEEE Trans. Antennas Propag., vol. 55, No. 7, pp. 2107-2110, Jul. 2007.
Mruk, J.R., Filipovic, D.S, "Micro-coaxial V-/W-band filters and contiguous diplexers," Microwaves, Antennas & Propagation, IET, Jul. 17, 2012, vol. 6, issue 10, pp. 1142-1148.
Mruk, J.R., Saito, Y., Kim, K., Radway, M., Filipovic, D.S., "Directly fed millimetre-wave two-arm spiral antenna," Electronics Letters, Nov. 25, 2010, vol. 46 , issue 24, pp. 1585-1587.
N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.
N. Ehsan, "Broadband Microwave Lithographic 3D Components," Thesis, 2009.
N. Ehsan, K. Vanhille, S. Rondineau, E. Cullens, Z. Popovic, "Broadband Wilkinson Dividers," IEEE Trans. Microwave Theory Tech., Nov. 2009, pp. 2783-2789.
N. Ehsan, K.J. Vanhille, S. Rondineau, Z. Popovic, "Micro-coaxial impedance transformers," IEEE Trans. Microwave Theory Tech., Nov. 2010, pp. 2908-2914.
N. Jastram, "Design of a Wideband Millimeter Wave Micromachined Rotman Lens," IEEE Transactions on Antennas and Propagation, vol. 63, No. 6, Jun. 2015.
N. Jastram, "Wideband Millimeter-Wave Surface Micromachined Tapered Slot Antenna," IEEE Antennas and Wireless Propagation Letters, vol. 13, 2014.
N. Jastram, "Wideband Multibeam Millimeter Wave Arrays," IEEE 2014.
N. Jastram, D. Filipovic, "Monolithically integrated K/Ka array-based direction finding subsystem," Proc. IEEE—APS/URSI Symposium, Chicago, IL, Jul. 2012, pp. 1-2.
N. Jastram, D. S. Filipovic, "Parameter study and design of W-band micromachined tapered slot antenna," Proc. IEEE—APS/URSI Symposium, Orlando, FL, Jul. 2013, pp. 434-435.
N. Jastram, D. S. Filipovic, "PCB-based prototyping of 3-D micromachined RF subsystems," IEEE Trans. Antennas Propag., vol. 62, No. 1, Jan. 2014. pp. 420-429.
N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.
N.A. Sutton, D. S. Filipovic, "V-band monolithically integrated four-arm spiral antenna and beamforming network," Proc. IEEE—APS/URSI Symposium, Chicago, IL, Jul. 2012, pp. 1-2.
N.A. Sutton, J. M. Oliver, D. S. Filipovic, "Wideband 15-50 GHz symmetric multi-section coupled line quadrature hybrid based on

(56) References Cited

OTHER PUBLICATIONS surface micromachining technology," 2012 IEEE MTT-S Int. Microwave, Symp., Montreal, Canada, Jun. 2012.
N.A. Sutton, J.M. Oliver, D.S. Filipovic, "Wideband 18-40 GHz surface micromachined branchline quadrature hybrid," IEEE Microwave and Wireless Components Letters, Sep. 2012, vol. 22, No. 9, pp. 462-464.
P. Ralston, K. Vanhille, A. Caba, M. Oliver, S. Raman, "Test and verification of micro coaxial line power performance," 2012 IEEE MTT-S Int. Microwave, Symp., Montreal, Canada, Jun. 2012.
P. Ralston, M. Oliver, K. Vummidi, S. Raman, "Liquid-metal vertical interconnects for flip chip assembly of GaAs C-band power amplifiers onto micro-rectangular coaxial transmission lines," IEEE Compound Semiconductor Integrated Circuit Symposium, Oct. 2011.
P. Ralston, M. Oliver, K. Vummidi, S. Raman, "Liquid-metal vertical interconnects for flip chip assembly of GaAs C-band power amplifiers onto micro-rectangular coaxial transmission lines," IEEE Journal of Solid-State Circuits, Oct. 2012, vol. 47, No. 10, pp. 2327-2334.
S. Huettner, "High Performance 3D Micro-Coax Technology," Microwave Journal, Nov. 2013. [online: http://www.microwavejournal.com/articles/21004-high-performance-3d-micro-coax-technology].
S. Huettner, "Transmission lines withstand vibration," Microwaves and RF, Mar. 2011. [online: http://mwrf.com/passive-components/transmission-lines-withstand-vibration].
T. Durham, H.P. Marshall, L. Tsang, P. Racette, Q. Bonds, F. Miranda, K. Vanhille, "Wideband sensor technologies for measuring surface snow," Earthzine, Dec. 2013, [online: http://www.earthzine.org/2013/12/02/wideband-sensor-technologies-for-measuring-surface-snow/].
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
T. Liu, F. Houshmand, C. Gorle, S. Scholl, H. Lee, Y. Won, H. Kazemi, K. Vanhille, M. Asheghi, K. Goodson, "Full-Scale Simulation of an Integrated Monolithic Heat Sink for Thermal Management of a High Power Density GaN—SiC Chip," InterPACK/ICNMM, San Francisco, CA, Jul. 2015.
T.E. Durham, "An 8-40GHz Wideband Instrument for Snow Measurements," Earth Science Technology Forum, Pasadena, CA, Jun. 2011.
Written Opinion corresponding to PCT/US12/46734 dated Nov. 20, 2012.
Y. Saito, D. Fontaine, J.-M. Rollin, D.S. Filipovic, "Monolithic micro-coaxial power dividers," Electronic Letts., Apr. 2009, pp. 469-470.
Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
Z. Popovic, K. Vanhille, N. Ehsan, E. Cullens, Y. Saito, J.-M. Rollin, C. Nichols, D. Sherrer, D. Fontaine, D. Filipovic, "Micro-fabricated micro-coaxial millimeter-wave components," in 2008 Int. Conf. on Infrared, Millimeter and Terahertz Waves, Pasadena, CA, Sep. 2008, pp. 1-3.
Z. Popovic, S. Rondineau, D. Filipovic, D. Sherrer, C. Nichols, J.-M. Rollin, and K. Vanhille, "An enabling new 3D architecture for microwave components and systems," Microwave Journal, Feb. 2008, pp. 66-86.
International Search Report and Written Opinion for PCT/US2015/011789 dated Apr. 10, 2015.
Derwent Abstract Translation of WO-2010-011911 A2 (published 2010).
Tian, et al.; Fabrication of multilayered SU8 structure for terahertz waveguide with ultralow transmission loss; Aug. 18, 2013; Dec. 10, 2013; pp. 13002-1 to 13002-6.
Yoon et al., "High-Performance Electroplated Solenoid-Type Integrated Inductor (S12) for RF Applications Using Simple 3D Surface Micromachining Technology", Int'l Election Devices Meeting, 1998, San Francisco, CA, Dec. 6-9, 1998, pp. 544-547.
International Search Report dated Aug. 29, 2005 on corresponding PCT/US04/06665.
S. Scholl, C. Gorle, F. Houshmand, T. Liu, H. Lee, Y. Won, H. Kazemi, M. Asheghi, K. Goodson, "Numerical Simulation of Advanced Monolithic Microcooler Designs for High Heat Flux Microelectronics," InterPACK, San Francisco, CA, Jul. 2015.

* cited by examiner

MULTILAYER BUILD PROCESSES AND DEVICES THEREOF

This is a continuation application of U.S. application Ser. No. 15/003,985, filed Jan. 22, 2016, which in turn claims the benefit of priority of U.S. application Ser. No. 13/965,524, filed Aug. 13, 2013, which in turn claims the benefit of priority of U.S. application Ser. No. 12/953,393, filed Nov. 23, 2010, which in turn claims the benefit of priority of U.S. Provisional Application No. 61/263,777, filed on Nov. 23, 2009, the entire contents of which application(s) are incorporated herein by reference.

FIELD OF THE INVENTION

The present invention relates generally to electric, electronic and/or electromagnetic devices, and processes thereof, and more particularly but not exclusively to multilayer build processes to build a multilayer electromagnetic device or a electromagnetic mechanical device.

BACKGROUND

Existing device build processes may suffer from various limitations, such as a difficulty in building a multi-layer structure which employs a plurality of integration processes, for example mid-build of a process flow, to create an end device. In addition, existing processes may exhibit undesired challenges in defining the location, in the plane of the fabrication or substrate, of two or more materials, which may be non-insulative, in the same layer of a multi-layer structure. Further, providing integration of magnetic materials into a multi-layer build process, for example to fabricate an electromagnetic structure, may be a limitation of existing device build processes. Moreover, leveraging various approaches and/or applications may remain problematic in current device build processes, where, for example, multiple materials may need to be integrated hybridly and/or monolithically into a mixed material structure.

Figure 15:
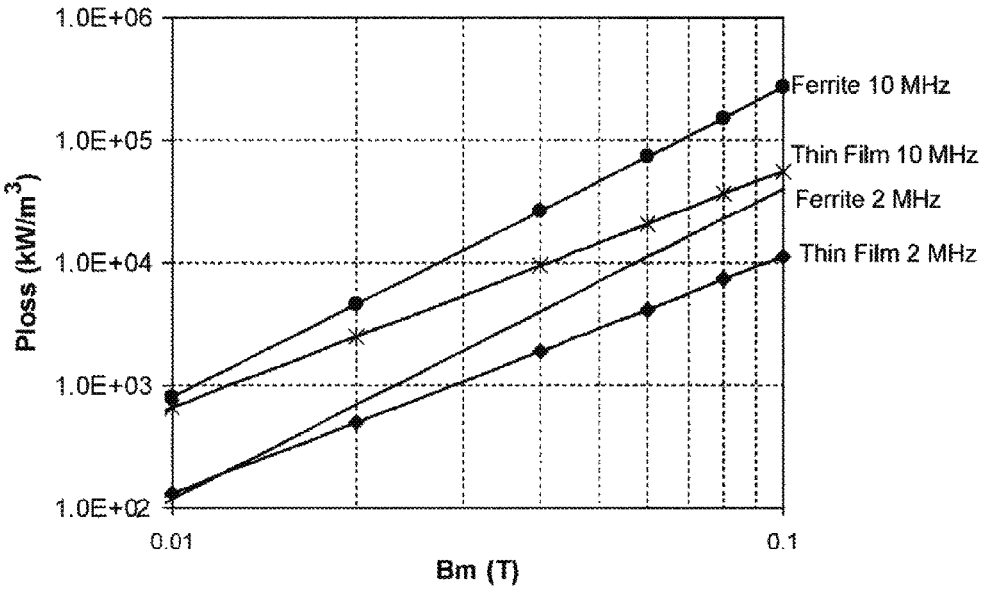
(PRIOR ART) FIG. 15

Moreover, power supply on chip (PSoC) is a concept that is generating a lot of interest because of the current industry drive towards miniaturization and higher efficiency. For this to happen, switching frequencies must increase, enabling the inductors and the capacitors within the power supply to shrink. As the switching frequency increases above 0.5 MHz for switch mode power supplies ferromagnetic materials show more promise than ferrite materials because of greater saturation flux density and lower losses, as can be seen in FIG. 15. For this to be the case, the thickness of the ferromagnetic films must be on the order of a skin depth, but for high flux densities, the loss is 4 to 5 times higher in the ferrite material—clearly indicating the advantage of properly engineered ferromagnetic materials for high-power-density applications. A value for total magnetic core thickness on the order of 10 s or 100 s of microns is desirable to achieve low-loss coils.

Therefore, a need exists for processes, and devices thereof, which may include one or more of: releasability from a handle wafer; CMOS process compatibility; ability to be produced on a variety of substrate materials; flexible passivation coating options; integration of thin-film and/or solders; interconnection to wafer surface microelectronics; and/or, an ability to micromachine a substrate wafer. More particularly, a need exists for versatile processes, and/or devices thereof, which may be applicable to magnetic and electro-magnetic MEMS and/or relatively small-scale applications, such as in the context of the multi-layer build process.

SUMMARY

Figure 13:
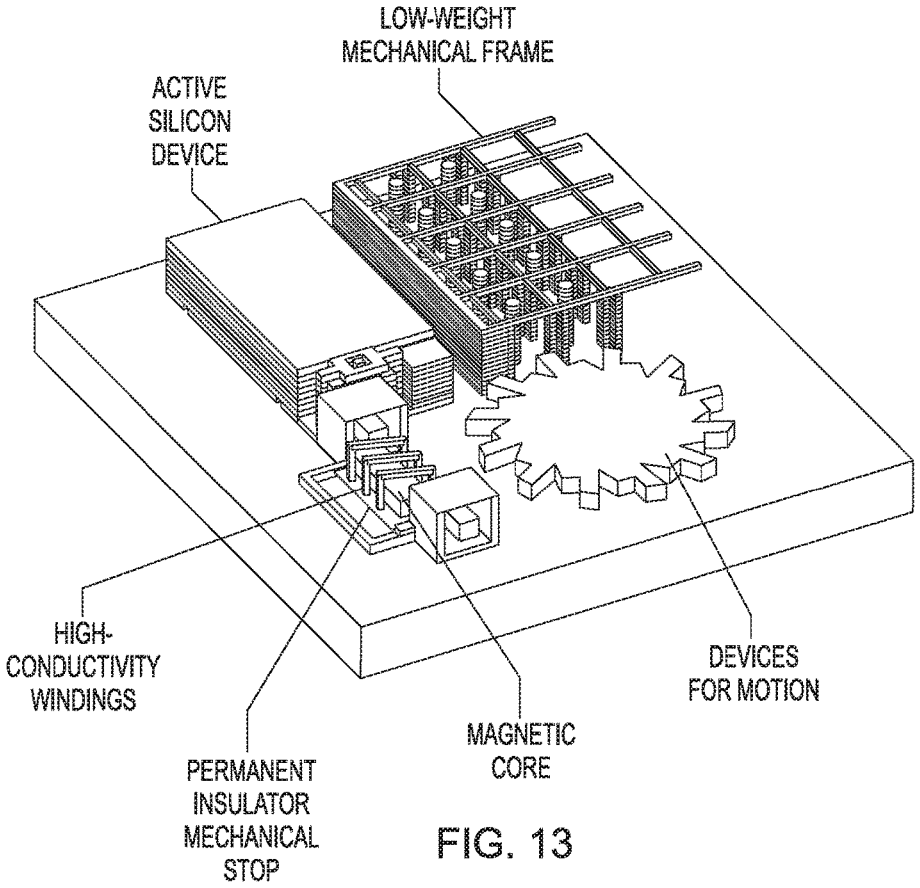

Embodiments relate to electric, electronic, mechanical, and/or electromagnetic devices, and methods thereof. Some embodiments relate to multilayer build processes, for example to build a multilayer electromagnetic device or a electromagnetic mechanical device. Some embodiments relate to multi-layer build processes including one or more material integration processes, for example including transfer bonding, lamination, pick-and-place, deposition transfer (e.g., slurry transfer), and/or electroplating on and/or over a previous layer, which may be mid build of a process flow to create an end device. The device may yield in batch discreet components on or released from a wafer or substrate or PolyStrata® wafer or MEMS wafer or a combination thereof. For example, in one of its aspects, the present disclosure demonstrates the feasibility of integrating magnetic materials with intricate low-loss metal coils and/or metal mechanical structures which may result in relatively thick magnetic MEMS or power-converters or transformers or devices on a wafer level, which may enable maximized force, maximized throw, and/or maximized power applications that may be prohibitive for a thin-film-type MEMS. For example, the technology of the present disclosure may produce relatively well controlled metal elements that may serve as micro-mechanical components within the same build and/or at scales of up to approximately 1 mm in height. As such, the present disclosure may provide a new series of meso-scale high-force actuators, motors, power-transformers, and transducers that together may produce micro-systems that fill a technology gap between thin-film MEMS technology and miniature precision assemblies, while maintaining the wafer-level capabilities of batch fabrication and/or scalability in semiconductor processing. FIG. 13 shows a concept-level image of this with integration of the relevant components for micro-scale systems. In addition, embodiments of the present disclosure may relate to various methods of incorporating magnetic materials, such as direct monolithic integration and/or hybrid integration mid-build to allow magnetic cores with wound coils, for example. For instance, the technology of the present invention may enable wafer-scale fabrication of highly-integrated devices and/or systems incorporating magnetic materials, actuation, low-loss coils, flexures (e.g., torsion and/or cantilevers), for power levels that are not achievable using thin-film methods and/or may not be otherwise fabricated. Moreover, the present invention may provide precision machining and high-aspect-ratio microstructures; high volume, low cost; lower voltage, higher current; and, higher heat load.

Embodiments relate to multilayer structures where the in-plane location of two or more materials, which may be non-insulative, may be defined in the same layer of a multi-layer structure. Embodiments relate to integration of magnetic materials or mechanical materials into a multi-layer build process, for example to fabricate an electromagnetic structure. In embodiments, multi-layer build processes may be sufficiently general to be leveraged in various approaches and/or applications where multiple materials may be integrated hybridly and/or monolithically into a mixed material structure.

An understanding of fabrication processes in accordance with the present invention may impart understanding of the flexibility and/or precision achievable using such processes.

Fabrication may be done on 150-mm-diameter silicon handle wafers. The features of each stratum across a wafer may be defined using photolithography, and/or x-y alignment from layer to layer may be done with approximately ±2 μm accuracy. Once a pattern is defined and/or developed, photoresist may be used as a mold to plate, for example, copper features. Copper may be planarized using a chemical-mechanical polishing (CMP) process with a photoresist serving as a vertical stop for the CMP process. Photo-patternable permanent dielectric supports and/or sheets may be embedded in a device, and/or a photolithography process may begin anew, with the steps substantially repeating themselves. This process may continue until a predetermined height of a structure has been achieved. Photoresist may be dissolved to leave air-filled copper structures with dielectric supports and/or sheets for a center conductor and/or other applications. The resulting structures may have strata of thicknesses between approximately 5 μm and 100 μm. Structures taller than approximately 1 mm may be fabricated using an approximately 20-mask process. The fabrication process may provide an ability to do many things with metal that have been limited to silicon. Using this process as a baseline, a magnetic MEMS toolbox may be provided as outlined herein.

Technology in accordance with the present invention may include capabilities over methods demonstrated to make conductive microstructures in terms of number of layers, planarity between layers, and/or total thickness. Introducing magnetic materials into a process may open a door to a micro-magnetic tool-set. Low temperature methods may be used, for example less than approximately 125° C., to include our PolyStrata® process and/or to ensure minimal changes to un-released photomolds. The present invention may provide several methods to incorporate magnetic materials; for example, sputtering, electroplating, screen printing and/or indirectly by hybrid integration and/or lamination. For example, electroplating NiFe and/or multi-component alloys may be included. Alternative methods of the present invention for incorporating magnetic materials, where pre-processed materials with near-ideal bulk properties may be leveraged, include hybrid integration through methods such as lamination. In this case, thin sheets of bulk-processed magnetic materials may be laminated and/or patterned-or—pre-pattered and/or laminated onto a substrate and/or wafer that may be in process. This approach allows best-of-breed bulk-processed composites and/or alloys with substantially consistent material properties to be leveraged. Most alloys may be available in foil and thin sheet form. Many of these materials have properties that may not be rivaled through deposition, such as duplication of composition and/or purity, which challenges, may not address the microstructural complications in duplicating bulk processed materials. Thus, methods of the present invention that may incorporate a vast array of these and/or like materials in an ideal processed state into microstructures, where their properties may be leveraged in batch processed micro-devices, may be valuable.

In accordance with the present invention several methods may be provided to incorporate magnetic materials: for example, transfer bonding, direct bonding, sputtering, electroplating, screen printing and/or indirectly by hybrid integration and/or lamination. For example, electroplating NiFe and/or multi-component alloys may be included. While industrial and/or laboratory demonstrations for binary and/or ternary alloys with consistent properties may have been achieved for some alloys, for example NiFe, it may remain difficult to obtain substantially consistent material properties from batch to batch in a production environment as important physical parameters drift with, for example, bath use and/or time including grain structure, impurities and/or composition. Such physical properties may impact a consistency of important material parameters including permeability, saturation density, and/or susceptibility. Magnetic properties of ferromagnetic materials may depend greatly on previous history, state of strain, temperature, size, perfection and/or orientation of crystals, and/or effect of small traces of impurity may be enormous. Thickness control and/or uniformity of properties across a wafer and/or substrate may not have been addressed.

According to embodiments, a process to form a multi-layer structure may include forming a seed layer on and/or over a substrate. In embodiments, a substrate may include one or more layers, which may be an image-wise mold layer. In embodiments, an image-wise mold layer may include one or more materials, for example a conductive and/or insulative material. In embodiments, insulative material may include photoresist, such as a sacrificial photoresist as taught in the PolyStrata® art, and/or dielectric material.

According to embodiments, a process to form a multi-layer structure may include modifying a seed layer. In embodiments, a seed layer may be modified by selectively applying a temporary patterned passivation layer and/or by selectively removing the seed layer. In embodiments, selectively applying a temporary patterned passivation layer may include depositing a layer of passivation material on and/or over a seed layer and patterning the passivation material to expose a portion of the seed layer. In embodiments, an exposed conductive area may be an exposed portion of a seed layer. In embodiments, selectively applying a temporary patterned passivation layer may include selectively placing passivation material on and/or over a seed layer to block a portion of the seed layer. In embodiments, a passivation layer may be substantially thinner relative to the image-wise mold layer.

According to embodiments, selectively removing a seed layer may expose a portion of a substrate, for example a non-conductive portion of a substrate. In embodiments, an exposed conductive area may include the remaining portion of the seed layer or a portion of a previous layer.

According to embodiments, a process to form a multi-layer structure may include selectively forming an image-wise mold layer on and/or over a substrate, which may expose one or more conductive area. In embodiments, a process to form a multi-layer structure may electrodepositing a first material on and/or over an exposed conductive area.

According to embodiments, a process to form a multi-layer structure may include removing a temporary patterned passivation layer, revealing for example another conductive area. In embodiments, a process to form a multi-layer structure may include forming a second material on the other conductive area.

In embodiments, a first material and a second material may be different materials. In embodiments, a first material and/or a second material may be formed by an electrodeposition process, a transfer bonding process, a dispensing process, a lamination process, a vapor deposition process, a screen printing process, a squeegee process, and/or a pick-and-place process. In embodiments, one or more layers and/or materials may be planarized.

According to embodiments, a process to form a multi-layer structure may include selectively applying a temporary patterned passivation layer on a conductive substrate. In embodiments, a process to form a multi-layer structure may additionally include selectively forming an image-wise mold layer on and/or over a substrate, which may expose one or more conductive areas. In embodiments, a process to form a multi-layer structure may include forming a first material on and/or over at least one of the exposed conductive areas. In embodiments, a process to form a multi-layer structure may include removing a temporary patterned passivation layer, which may reveal or expose another conductive area. In embodiments, a process to form a multi-layer structure may include forming a second material on and/or over the other conductive area. In embodiments, a process to form a multi-layer structure may include placing a blocking material on and/or over one or more of exposed conductive areas. In embodiments, blocking material may include ceramic material or non-conductive material.

According to embodiments, a process to form a multi-layer structure may include forming a sacrificial image-wise mold layer on a substrate layer, which may exposed one or more portions of a substrate layer. In embodiments, a process to form a multi-layer structure may include selectively placing one or more first materials in one or more exposed portions of a substrate layer. In embodiments, a process to form a multi-layer structure may include forming one or more second materials on and/or over a substrate layer. In embodiments, a process to form a multi-layer structure may include removing a portion of a sacrificial image-wise mold layer.

In embodiments, placing may include any suitable process, including one or more of a transfer bonding process, a dispensing process, a lamination process, and/or a pick-and-place process. In embodiments, one or more layers and/or materials may be planarized. In embodiments, a transfer bonding process may include affixing a first material to a carrier substrate, patterning the material, affixing the patterned material to a substrate, and releasing the carrier substrate According to embodiments, a lamination process may include patterning a material before and/or after the material is laminated to a substrate layer. In embodiments, a patterned material may be supported by a support lattice to suspend it before it is laminated, and then it may be laminated to a substrate layer. In embodiments, a material may be selectively dispensed. In embodiments, two materials may be spaced apart from each other and/or adjacent each other.

According to embodiments, devices formed by processes in accordance with aspects of embodiments are provided and devices may be monolithically or hybridly integrated together.

DRAWINGS

Example FIG. 1A to FIG. 1H illustrates a multi-layer PolyStrata® build processes in accordance with one aspect of embodiments.

Example FIG. 2A to FIG. 2H illustrates a multi-layer PolyStrata® build processes in accordance with one aspect of embodiments.

Example FIG. 3A to FIG. 3D illustrates a multi-layer build processes including heterogeneous intra-layer metals and non-conductive materials in PolyStrata® builds/devices in accordance with one aspect of embodiments.

Figure 4:
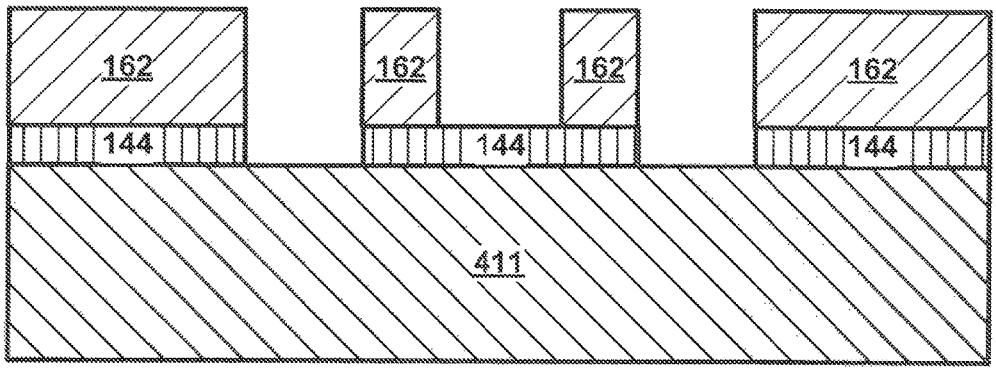

Example FIG. 4 illustrates a multi-layer build processes in accordance with one aspect of embodiments.

Figure 5:
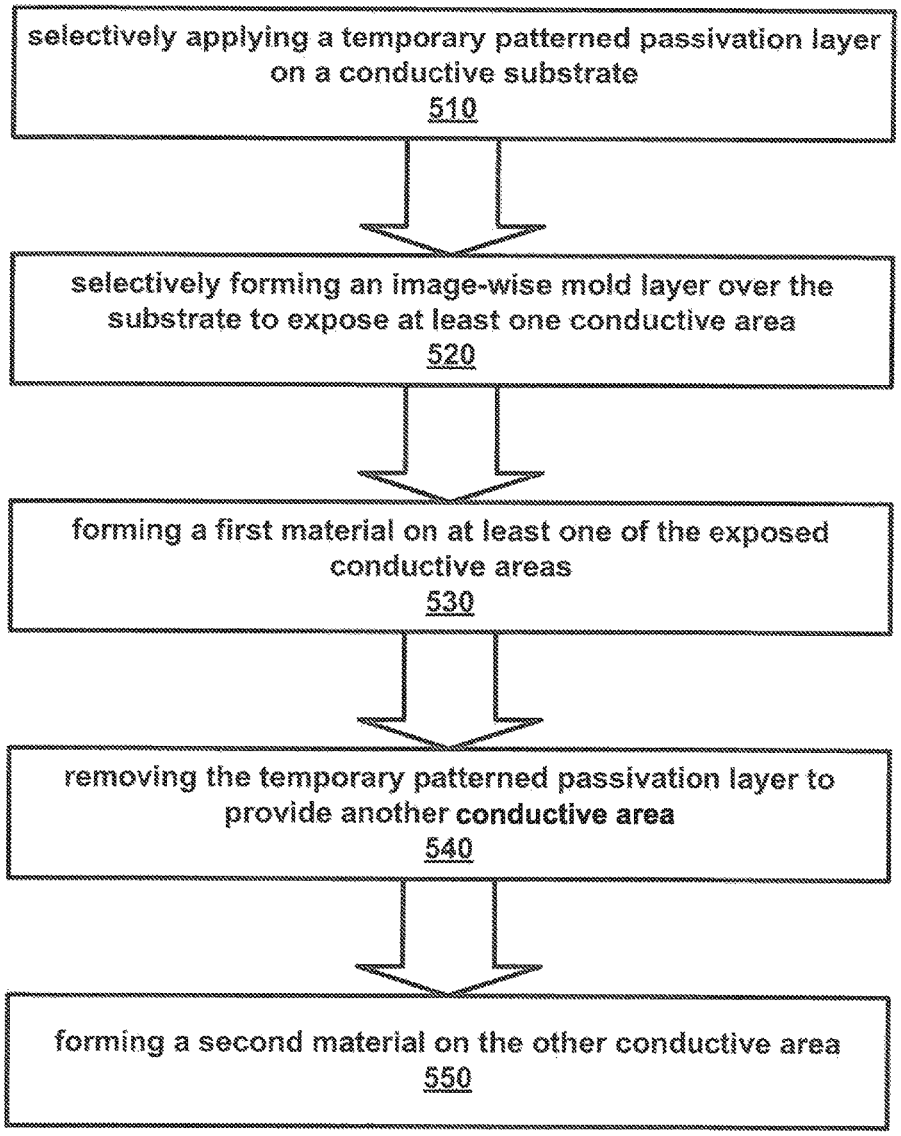

Example FIG. 5 illustrates a multi-layer build processes in accordance with one aspect of embodiments.

Figure 6:
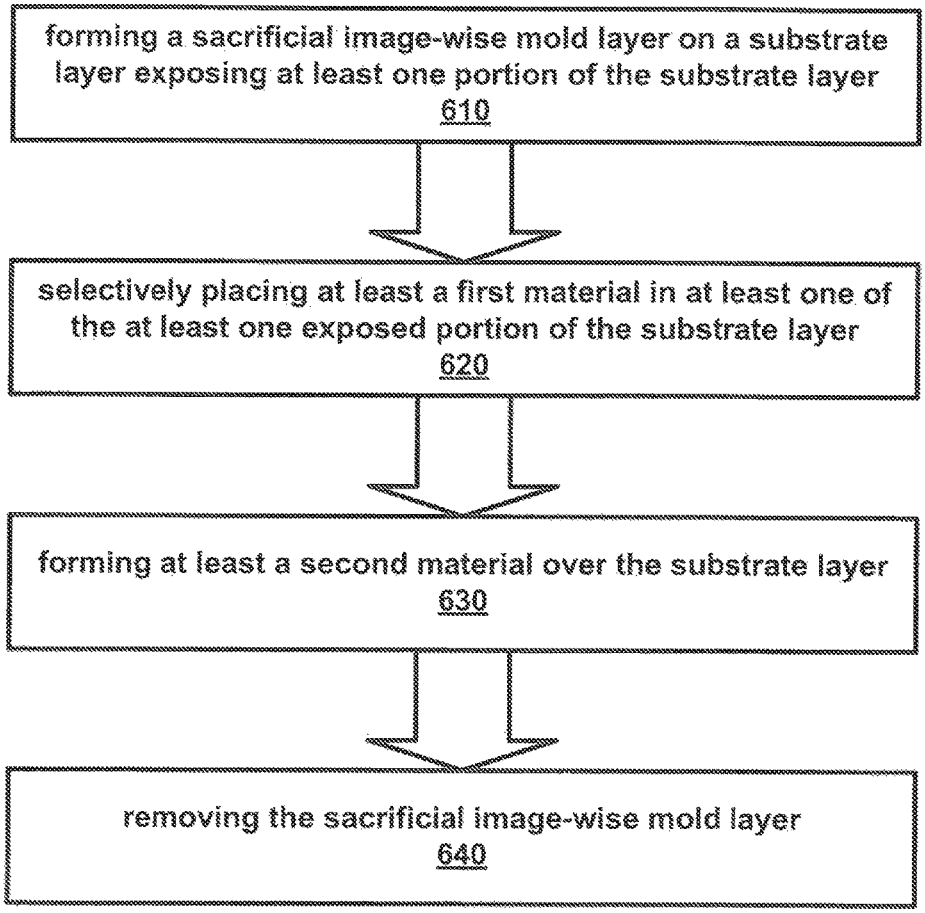

Example FIG. 6 illustrates a multi-layer build processes in accordance with one aspect of embodiments.

Figure 7:
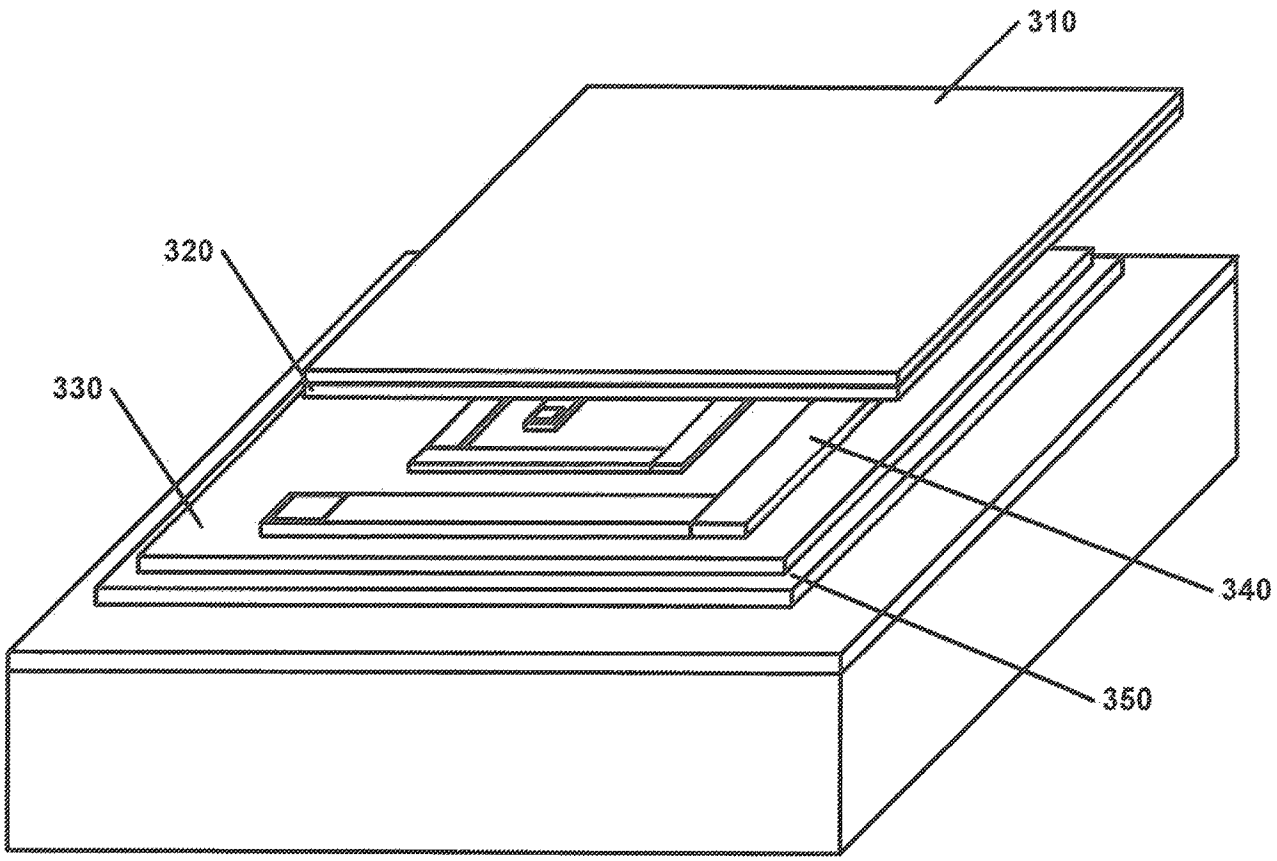

Example FIG. 7 illustrates a multi-layer structure in accordance with one aspect of embodiments.

Figure 8:
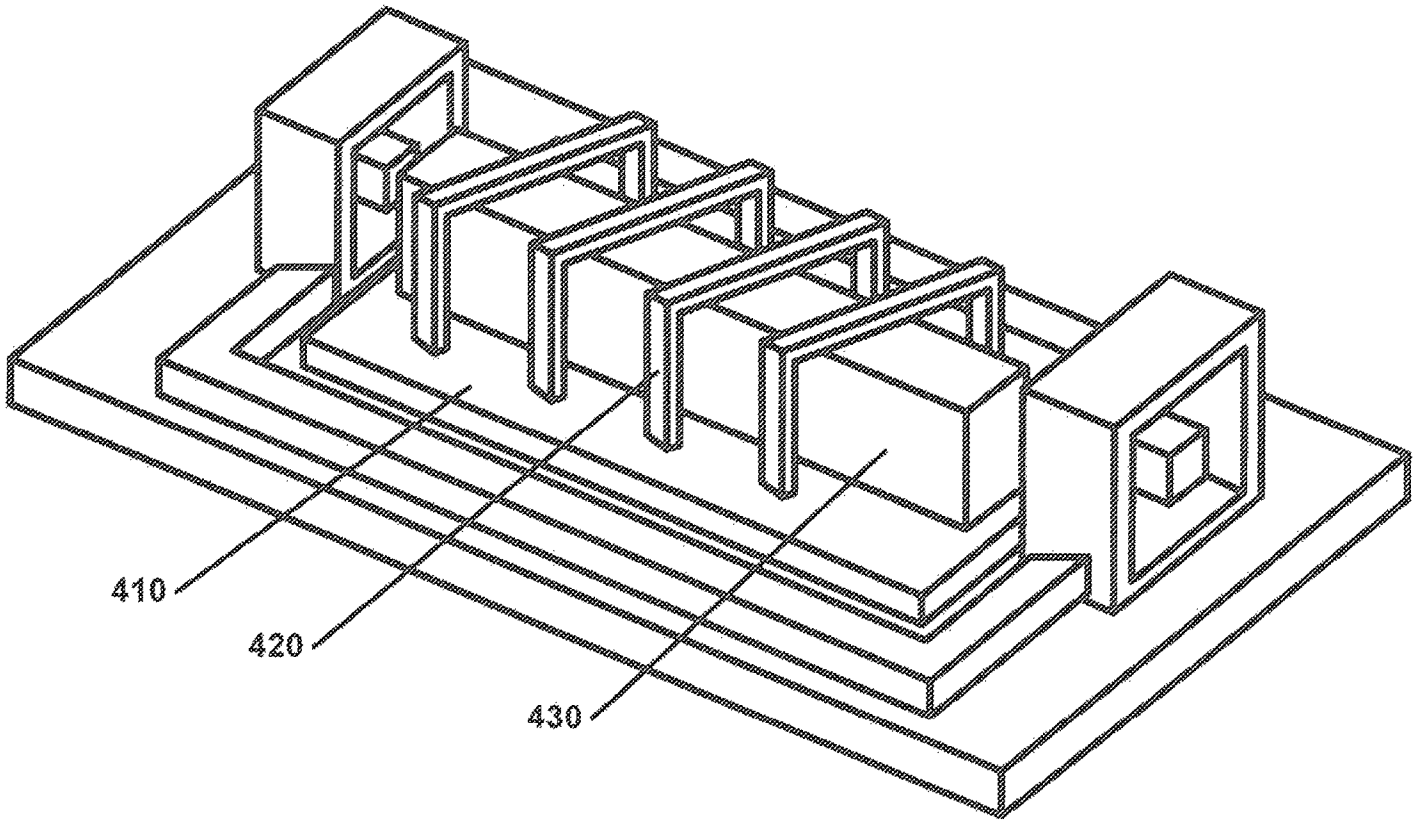

Example FIG. 8 illustrates a multi-layer structure in accordance with one aspect of embodiments.

Figure 9A:
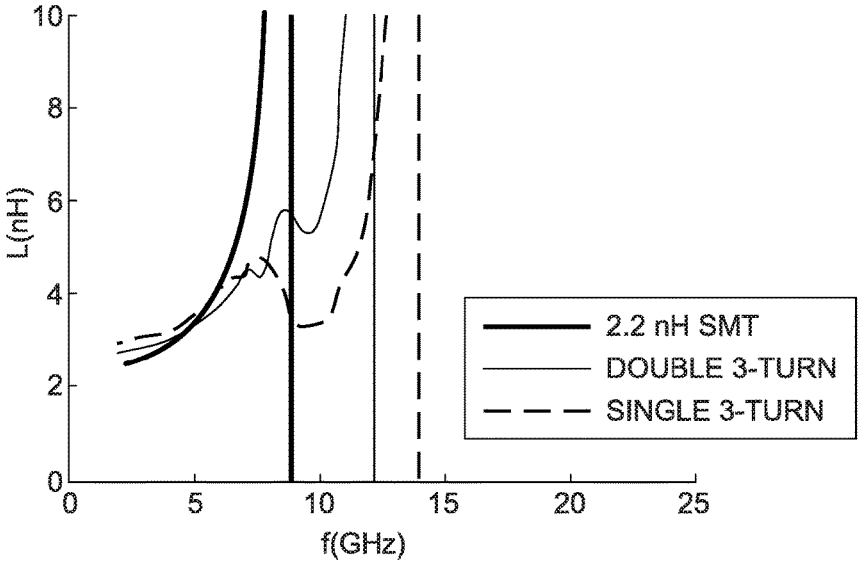

Example FIG. 9A illustrates a plot of L backed out from s-parameter measurements, assuming no parasitic capacitance; only the low-frequency value of the inductance may be realistic; the bold curve on the left corresponds to a 2.22 nH SMT 0402 packaged inductor, which may have expected has the lowest resonant frequency and/or inductance value.

Figure 9B:
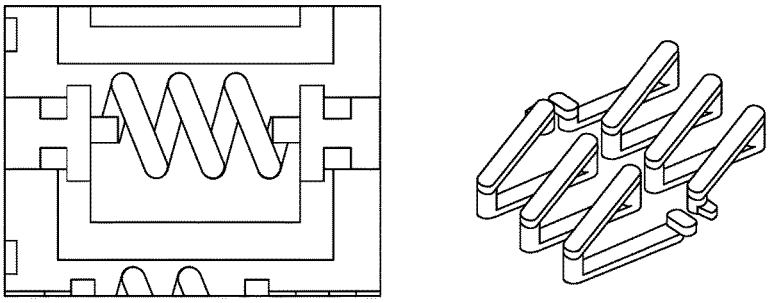

Example FIG. 9B illustrates a double 3-turn device, for which L=3.0 nH, freq=10.75 GHz, R=0.5 W, Q=46.

Figure 9C:
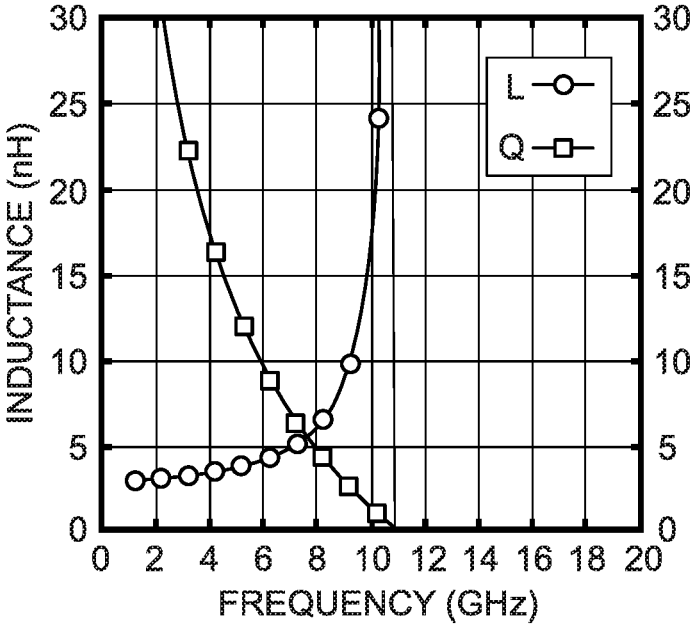

Example FIG. 9C illustrates the values derived from simulated s-parameters, which agrees quite well with FIG. 9B.

Figure 10:
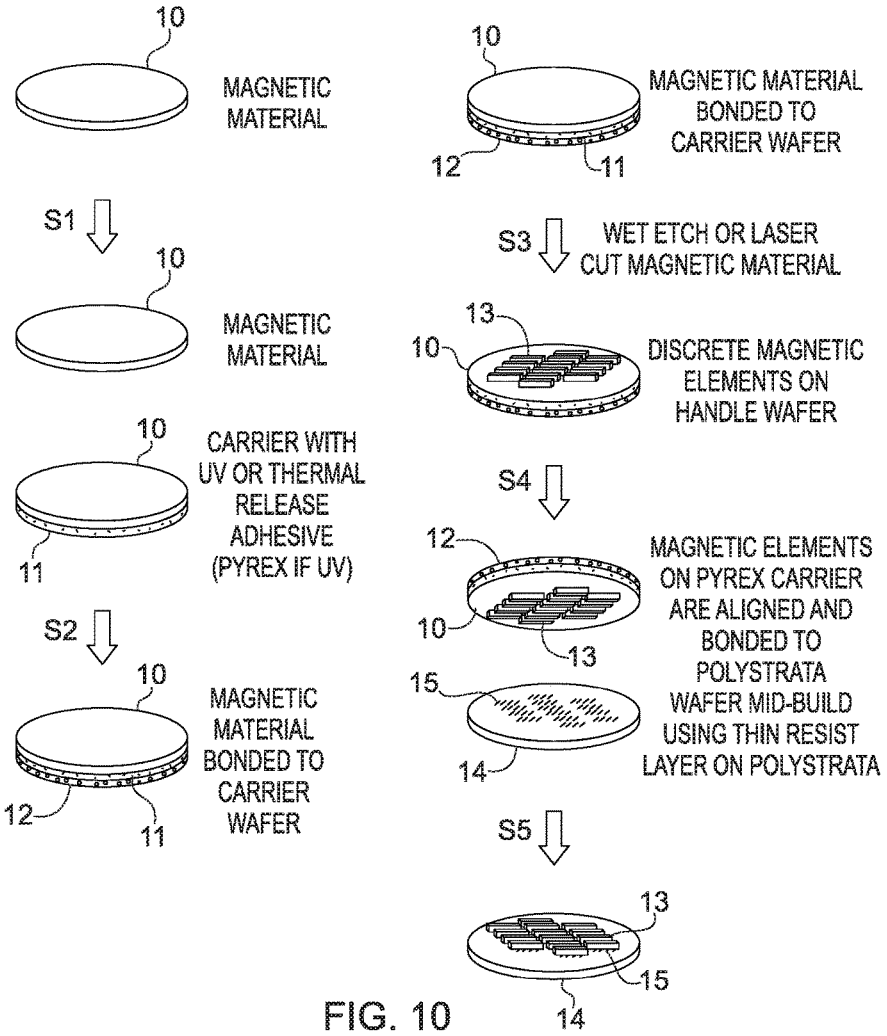

Example FIG. 10 illustrates an example process flow for a wafer-level transfer bonding process.

Figure 11:
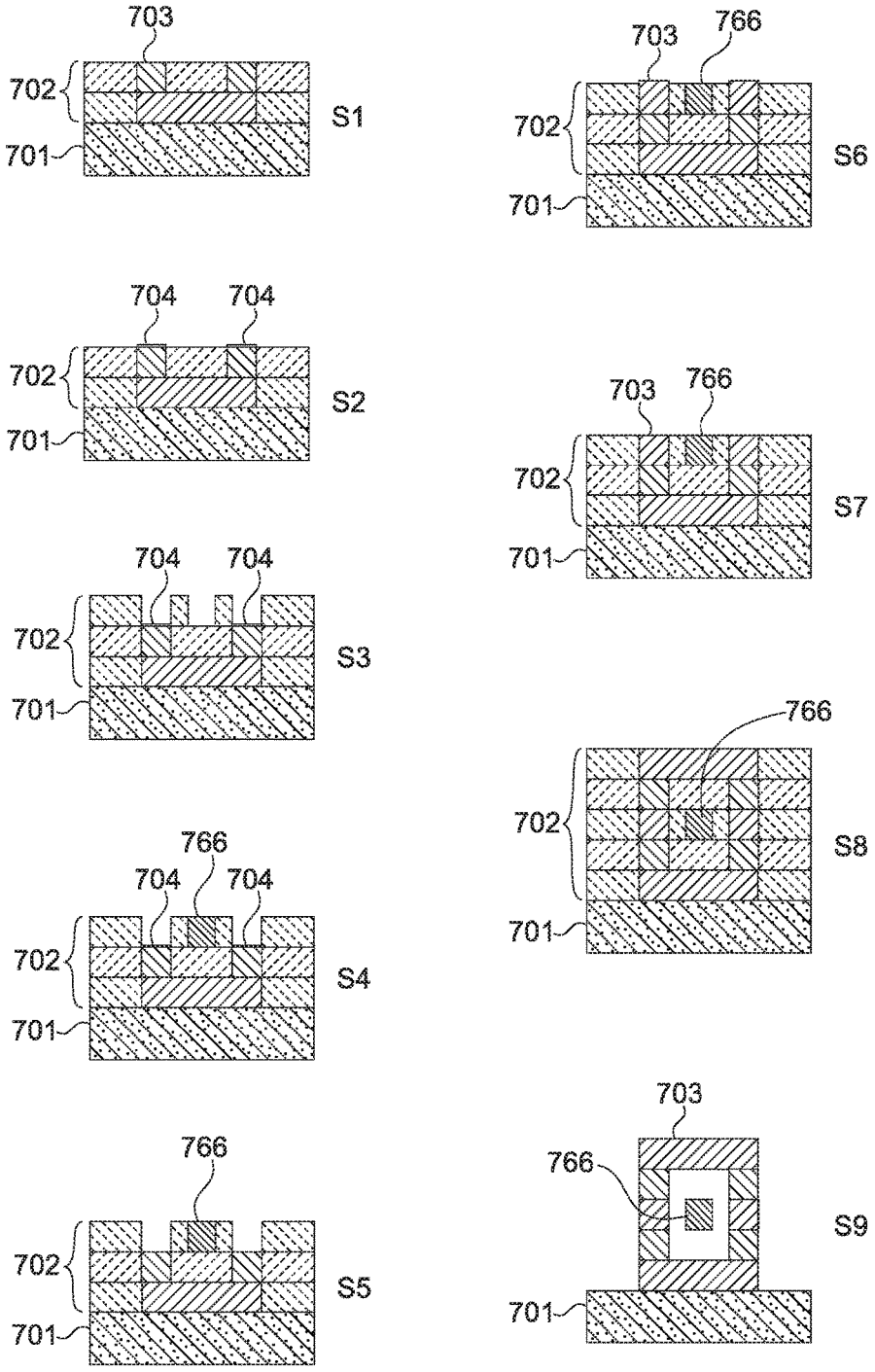

Example FIG. 11 illustrates an example process for monolithic intra-layer materials in PolyStrata® process/device.

Figure 12A:
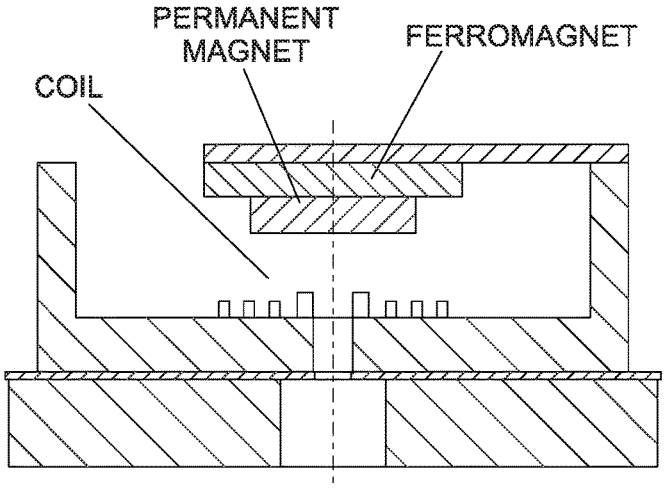
Figure 12B:
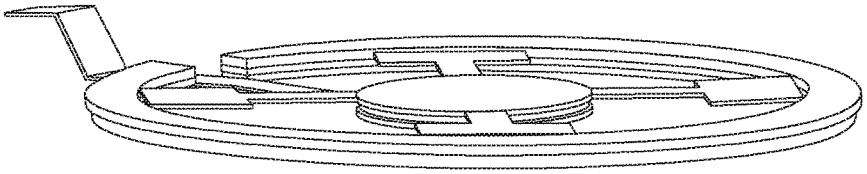

Example FIGS. 12A, 12B illustrate a electromagnetic-magnet actuated microvalve in accordance with one aspect of embodiments.

Example FIG. 13 illustrates the concept of the meso-scale magnetic MEMS enabled by the PolyStrata® technology for high-power density, large actuation applications.

Figure 14A:
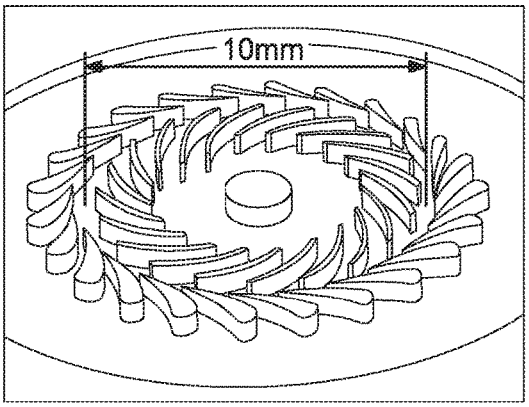
Figure 14B:
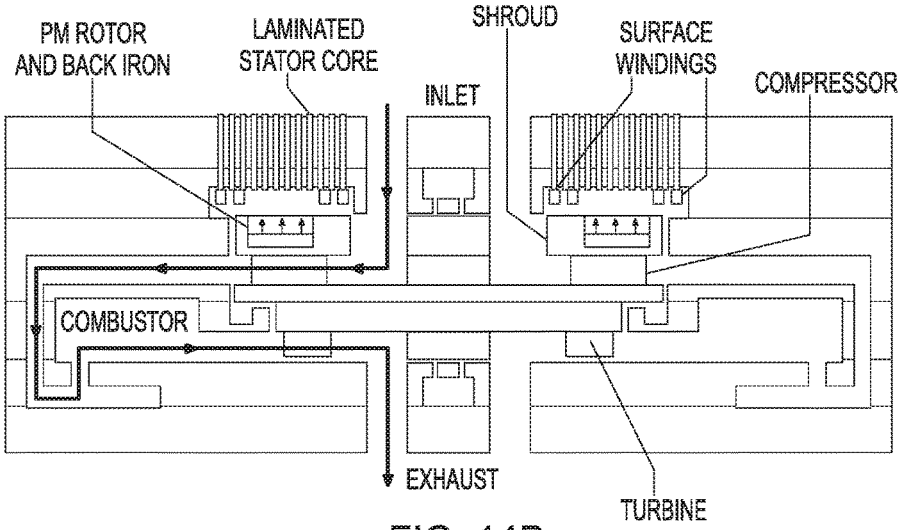

Example FIGS. 14A, 14B illustrate an integrated gas-turbine engine and electrical generator.

Example FIG. 15 illustrates an examination of loss in a high-performance commercial ferrite material (Ferroxcube) compared to core loss in a thin-film-deposited permalloy core; at 100 mT, the core loss is four to five time higher in the ferrite.

DESCRIPTION

Embodiments relate to electric, electronic and/or electromagnetic devices, and process thereof. Some embodiments relate to multi-layer build processes including one or more material integration processes, for example including transfer bonding, lamination, pick-and-place, deposition transfer (e.g., slurry transfer), and/or electroplating on and/or over a substrate layer, which may be mid build of a process flow to create an end device. Embodiments also relate to several processes of magnetic material integration, and devices thereof, such as the following exemplary methods: transfer bonding, for example of patterned foil/sheet material; direct bonding, for example of patterned metal sheets and/or "lead-frames"; pick-and-place hybrid integration, for example intra-build for ferrites and/or preformed cores; slurry/composite dispense and/or squeegee transfer, for example into and/or onto our devices for EMI shielding and/or to create cores post-release and/or intra build; and, plating/CMP of magnetic materials, for example into/onto our structures with CMP.

Embodiments relate to multilayer structures where the in-plane location of two or more materials, which may be non-insulative, may be defined in the same layer of a multi-layer structure. Embodiments relate to integration of magnetic materials into a multi-layer build process, for example to fabricate an electromagnetic structure. In embodiments, multi-layer build processes may be sufficiently general to be leveraged in various approaches and/or applications where multiple materials may be integrated hybridly and/or monolithically into a mixed material structure.

According to embodiments, the in-plane location of two or more materials which share a layer of a multi-layer structure may be defined. In embodiments, a first non-insulative material and a second non-insulative material may be formed and/or processed in the same layer of a multi-layer structure. In embodiments, the in-plane location on two or more non-insulative materials may be defined to be adjacent each other in the same layer of a multi-layer structure and/or spaced apart from each other. In embodiments, a non-insulative material may include a conductive material, for example Cu, and/or magnetic material, for example NiFe, NiCo and/or other magnetic alloys, which may be also be conductive. In embodiments, a non-conductive ceramic may be incorporated.

According to embodiments, a multi-layer build process may include providing a substrate. In embodiments, a substrate may be conductive, insulative, magnetic and/or non-conductive. In embodiments, a substrate may include one or more substrate layers. In embodiments, a substrate layer may include conductive, insulative, magnetic and/or non-conductive material. In embodiments, for example, a substrate layer may include one or more support structures, illustrated for example in U.S. Pat. Nos. 7,012,489, 7,649,432 and/or 7,656,256, each of which are incorporated by reference herein in their entireties. In embodiments, a conductive substrate layer may include one portion having a conductive material and a second portion having a different conductive material. In embodiments, a substrate layer may be and/or include a permanent dielectric layer including material such as SU-8, BCB, and/or polyamide.

According to embodiments, a multi-layer build process may include providing one or more image-wise mold layers. In embodiments, the term "image-wise" may reference a deliberate pattern and/or art-work, which may define a layer, and the term "mold" may reference a patterned layer which may define the space for incorporation of one or more materials. In embodiments, an image-wise mold layer may be a photoresist. In embodiments, an image-wise mold layer may be a relatively thick photoresist, for example approximately 10 to over 1000 microns in thickness. In embodiments, an image-wise mold layer may be a sacrificial material, which may be removed during and/or at the end of a multi-layer build process. In embodiments, an image-wise mold layer may be a patterned metal layer electroplated through a mask also used to define one or more materials. In embodiments, a patterned metal layer may be a sacrificial material. In embodiments, a layer may be a stamped, cut, photopatterned and/or otherwise formed layer, which may be laminated and/or adhered to a substrate in a multi-layer build process.

According to embodiments, a layer may define, within its patterned bounds, the location of two or more materials, for example adjacent and/or apart from one another. In embodiments, a layer may minimize and/or eliminate separate alignment steps for two or more layers, allowing a single pattern applied at one time to define the location of two or more materials. In embodiments, an image-wise mold layer may minimize and/or prevent the need to apply a mold layer a second time to define a second material. In embodiments, an image-wise mold layer may minimize and/or prevent complications associated with applying a mold layer a second time, for example by minimizing and/or eliminating the challenges of applying a mold layer over a patterned material. Such challenges may include voids, bubbles, striations, and/or other defects associated with applying a mold a second time to a resulting topography of the surface.

Referring to example FIG. 1A to FIG. 1H, a multi-layer build processes is illustrated in accordance with one aspect of embodiments. According to embodiments, a multi-layer additive build process may include forming one or more image-wise mold layers, which may form part of a substrate. As illustrated in one aspect of embodiments in FIG. 1A, two image-wise mold layers having image-wise mold material 122 and/or 132 may be formed on and/or over substrate layer 111. In embodiments, an image-wise mold material may be a relatively thick non-conductive material, for example a photoresist. In embodiments, the thickness of an image-wise mold material may be referenced against the thickness of a passivating layer and/or a seed layer. In embodiments, the thickness of an image-wise mold layer the may be approximately several microns to 1000 or more microns. In embodiments, the thickness of an image-wise mold layer the may be between approximately 10 and 100's of microns.

According to embodiments, one or more processes may be employed to form a layer. In embodiments, processes used to form a layer may include forming a patterned photoresist and/or patterned plastic, forming a patterned metal that may be a sacrificial metal, ink-jet and/or rapid prototyping processes, for example where material is applied from a reservoir through an automated mechanical process. Material may be also applied by extrusion coatings. In embodiments, patterning a layer may be accomplished by any suitable process, for example cutting and/or milling by laser and/or mechanical processes. In embodiments, a layer may be a sacrificial material that is removed at the end of the processing leaving behind the materials it defines.

As illustrated in one aspect of embodiments in FIG. 1A, two sequential image-wise mold layers may be formed over substrate layer 111, and/or may have image-wise mold material 122 and/or 132 together with any other suitable material. In embodiments, any material may fill an image-wise mold layer, for example conductive material and/or insulative material. In embodiments, an image wise mold may be filled by metal material 123 and/or 133, and/or by dielectric material 192. In embodiments, a material may fill a mold by any suitable process, for example including an electroplating and/or squeegee process. In embodiments, for example where dielectric material 192 may be formed in a squeegee process or doctor blade process, a layer of permanent passivation material (not shown) may be formed such that dielectric material 192 is formed on the permanent passivation material, for example after metal material 133 has been electrodeposited. In embodiments, a pick-and-place process, transfer-bonding process and or lamination process may be employed to insert material 192 between image-wise mold material 132.

According to embodiments, a multi-layer build process may include forming one or more seed layers 144 on a substrate. In embodiments, a seed layer may 144 be disposed between two layers in a multi-layer build process, for example between two image-wise mold layers 132, 162, FIG. 1C. In embodiments, a seed layer 144 may be a conductive layer used to facilitate growth, for example in electroplating at least a portion of a next layer 163. In embodiments, a first non-insulative material and/or a second material may be formed by any suitable process, for example wafer bonding, lead-frame bonding, pick-and-place, dispensing, lamination vapor deposition and/or by electrodeposition. In embodiments, a seed layer 144 may be used to facilitate formation of any material, for example semiconductive and/or insulative material. For example, deposition of non-conductors (e.g. semiconductors and insulators) has been presented in related art.

Figure 1B:
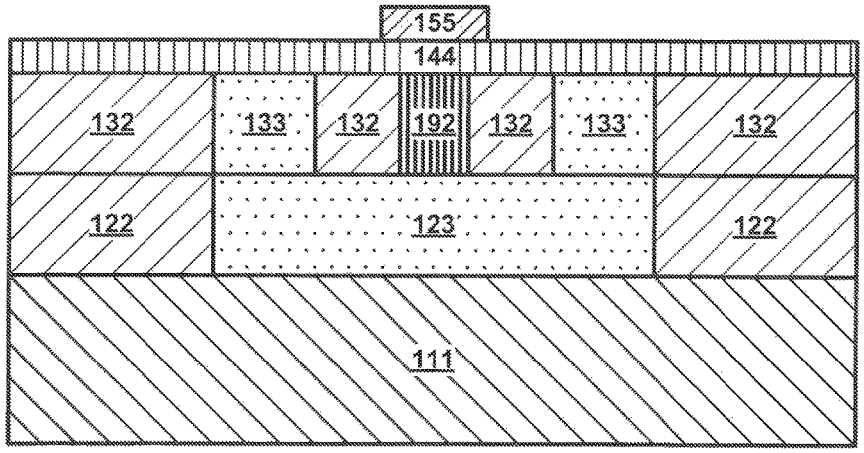
Figure 1C:
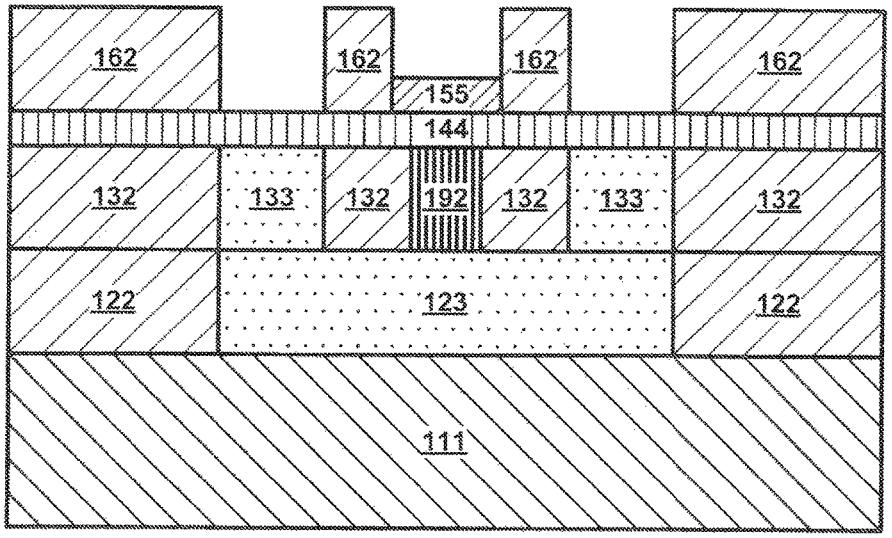

According to embodiments, a seed layer 144 may be formed, for example on and/or under an image-wise mold layer 132, 162 as illustrated in one aspect of embodiments in FIG. 1C. In embodiments, a seed layer 144 may be modified, for example by selectively applying a patterned passivation layer 155 on and/or over the seed layer 144. In embodiments, a patterned passivation layer 155 may be temporary, such that it may be removed to expose a portion of an underlying seed layer 144 in a subsequent step. In embodiments, selectively applying a temporary patterned passivation layer may include depositing a layer of passivation material on a seed layer and patterning the passivation material to expose a portion of the seed layer. In embodiments, selectively applying a temporary patterned passivation layer may include selectively placing passivation material on a seed layer to block a portion of the seed layer. In embodiments, a passivation layer 155 may be thin, for example substantially thinner relative to the thickness of an image-wise mold layer such as layer 162 in FIG. 1C. In embodiments, a passivation layer 155 may be a relatively thin non-conductive film, for example a relatively thin photoresist or a patterned inorganic dielectric. Referring to FIG. 1B, seed layer 144 may be modified by temporary patterned passivation layer 155.

According to embodiments, a seed layer 144 may be modified by any suitable process. In embodiments, for example, a seed layer 144 may be modified by selectively removing a portion of the seed layer 144. In embodiments, selectively removing a portion of the seed layer 144 may expose a non-conductive portion of a layer underlying the seed layer 144. Referring to FIG. 1B, for example, selectively removing a region of portion of seed layer 144 in the area above image-wise mold material 132 may expose non-conductive material 132. In embodiments, for example where a material is desired to be formed over dielectric material 192, passivation layer 155 may not be formed over insulation material 192 where seed layer 144 is present, and/or may be formed on and/or over metal material 133, such that a first material may be formed on the remaining exposed portion of seed layer 144 located on insulation material 144.

Referring to example FIG. 4, for example, seed layer 144 may be formed on non-conductive substrate 411, by selectively depositing and/or selective removal, to define one or more areas in which a first material may be formed. In embodiments, a seed layer may nucleate selective growth of materials through any suitable process, for example including CVD, PVD, and/or electroless deposition of materials. In embodiments, employing a passivated and/or patterned seed layer may enable material to be formed in an image-wise mold where the seed layer is exposed in the pattern. Such methods producing selective deposition based on the exposed surface chemistry are available in related art.

Figure 1D:
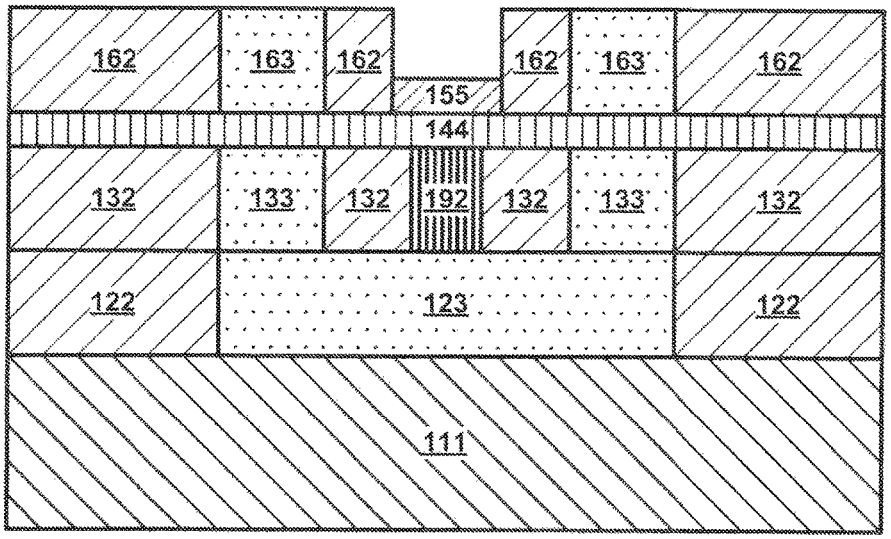
Figure 1E:
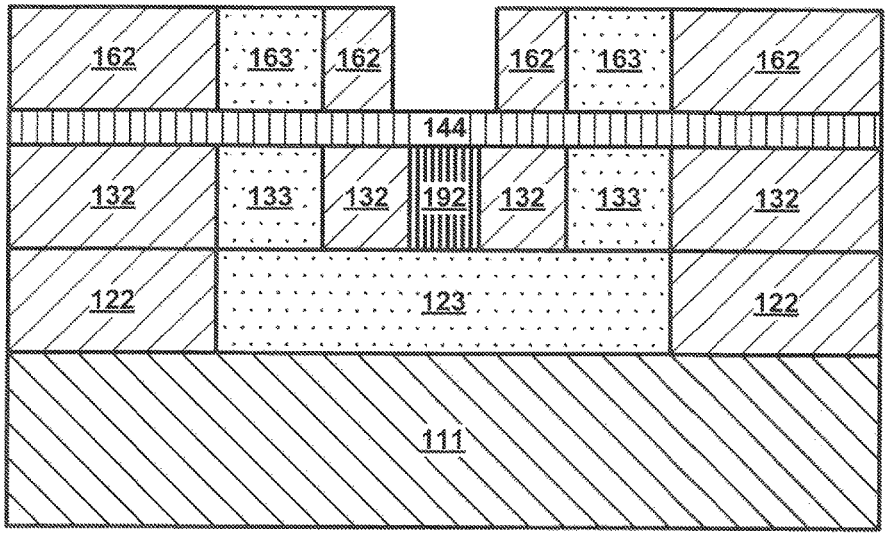

Referring back to FIG. 1C, an image-wise mold layer may be formed over a substrate 111, a seed layer 144 and/or a passivation layer 155. In embodiments, an image-wise mold layer may be applied and/or patterned to cooperate with a substrate, seed layer and/or passivation layer, and/or define the in-plane location of two materials sharing the same layer of a multi-layer structure. In embodiments, an image-wise mold may expose one or more conductive areas. As illustrated in one aspect of embodiments in FIG. 1C, an image-wise mold layer may be selectively formed over passivation layer 155, seed layer 144 and substrate 111, and expose two conductive areas. In embodiments, the two conductive areas may include the exposed areas of seed layer 144. Referring to FIG. 1D, first material 163 may be formed on the exposed portion of seed layer 144. In embodiments, first material 163 may be formed by any suitable process, for example the electrodepositing process. Referring to FIG. 1E, layer 155 may be removed. In embodiments, a passivation layer may be removed by any suitable process, for example by an etching process. In embodiments, removing layer 155 may expose a seed layer, as illustrated in one aspect of embodiments in FIG. 1E, and/or may expose a conductive and/or non-conductive portion of a layer underlying the passivation layer 155.

Figure 1F:
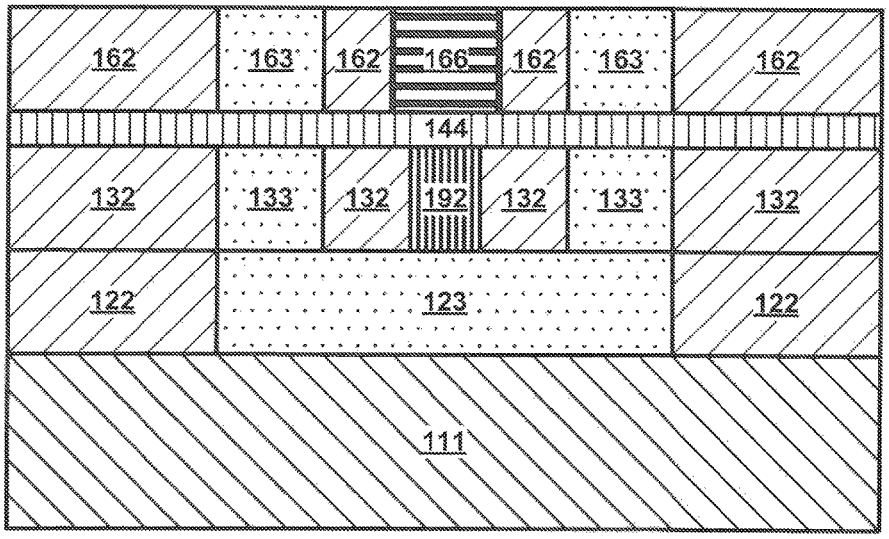
Figure 1G:
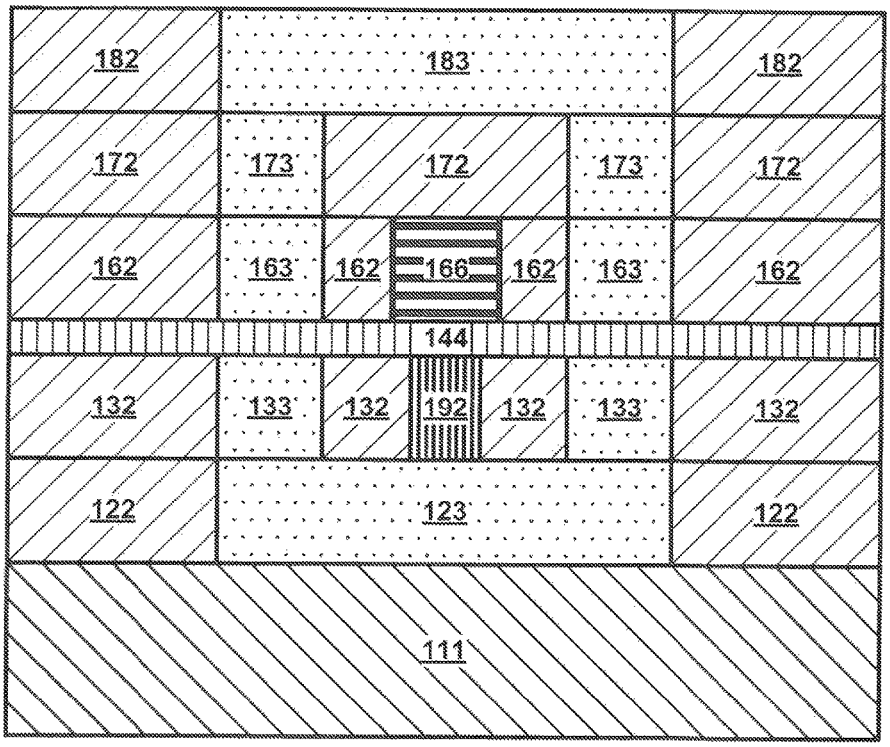
Figure 1H:
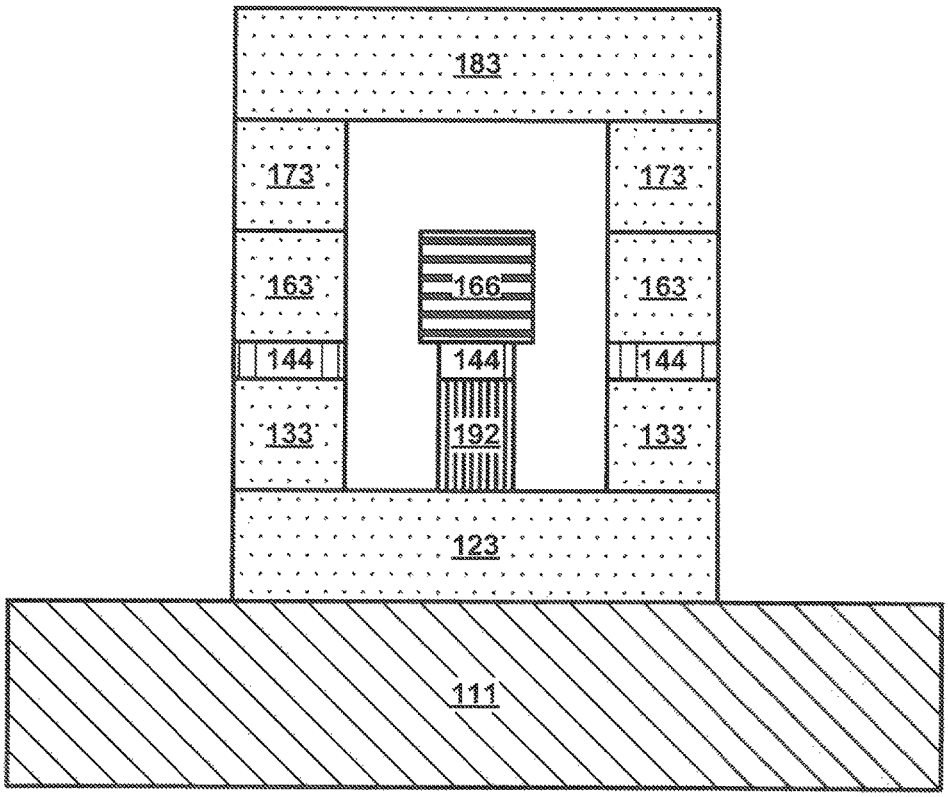

Referring to FIG. 1F, second material 166 may be formed on and/or over an exposed portion of seed layer 144. In embodiments, a second material may be formed by any suitable process, for example electrodeposition. In embodiments, electrodeposition may include electroplating insulative, conductive, and/or semiconducting materials. As illustrated in one aspect of embodiments in FIG. 1F, the in-plane location of first material 163 and second material 166, which share the same layer of the multi-layer structure, may be defined to be spaced apart from each other. Referring to FIG. 1G, image-wise mold material 172 and 182 form two image-wise mold layers over substrate 111. In embodiments, the two formed image-wise mold layers may be filled with any suitable material, for example metal material 173 and/or 183. Referring to FIG. 1H, one or more materials of a multi-layer structure may be removed, for example mold material 122, 132, 162, 172 and/or 182 and portions of seed layer 144 as well. In embodiments, end structures formed may be left on and/or over a substrate, for example a wafer, and/or detached from a substrate to mount into other systems. Referring to example FIG. 1H, a multi-layer structure is illustrated in accordance with one aspect of embodiments, which may or may not be removed from substrate layer 111.

In embodiments, one or more of layers of a multilayer structure may be made approximately planar to facilitate the application of a new mold material and/or subsequent layer. In embodiments, planarization may be accomplished by any suitable process, for example including chemical-mechanical polishing (CMP), lapping, polishing, mechanical cutting such a fly-cutting and/or diamond turning, etching, and/or mechanical scraping such as a through a doctor blade or squeegee. In embodiments, application of a mold material, formation of a first and/or second material, and/or planarization methods may be selected based on various factors, for example including mechanical scale (e.g., dimensions), materials required in a final construction, chemical compatibility of the process and/or precision.

Figure 2A:
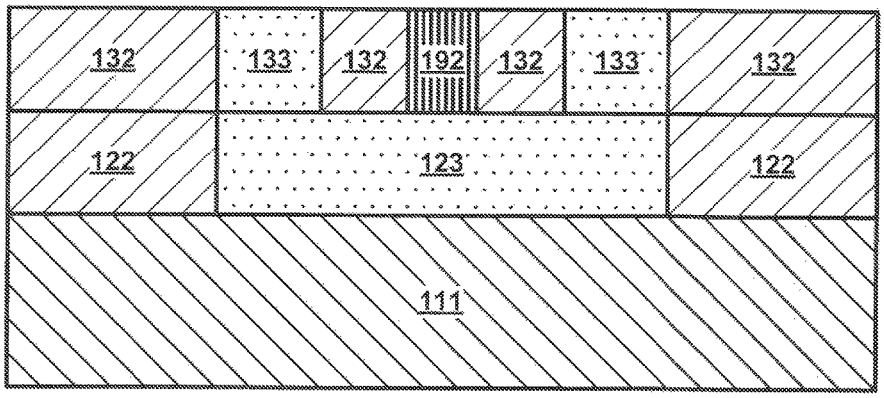
Figure 2B:
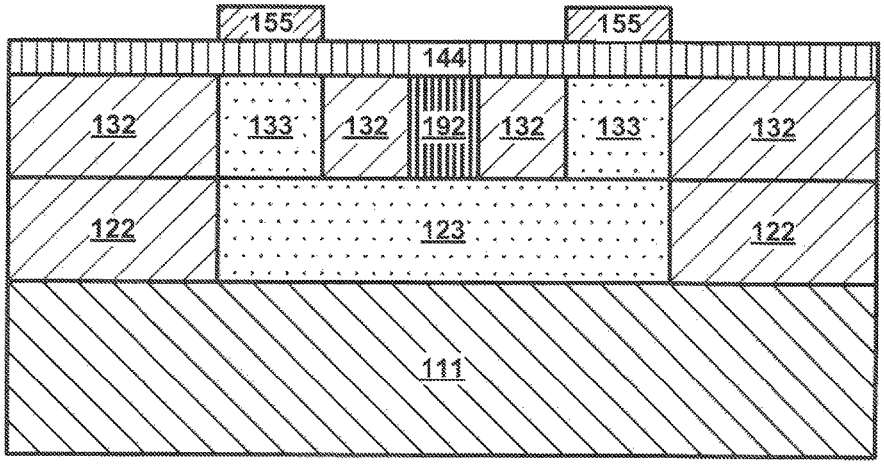
Figure 2C:
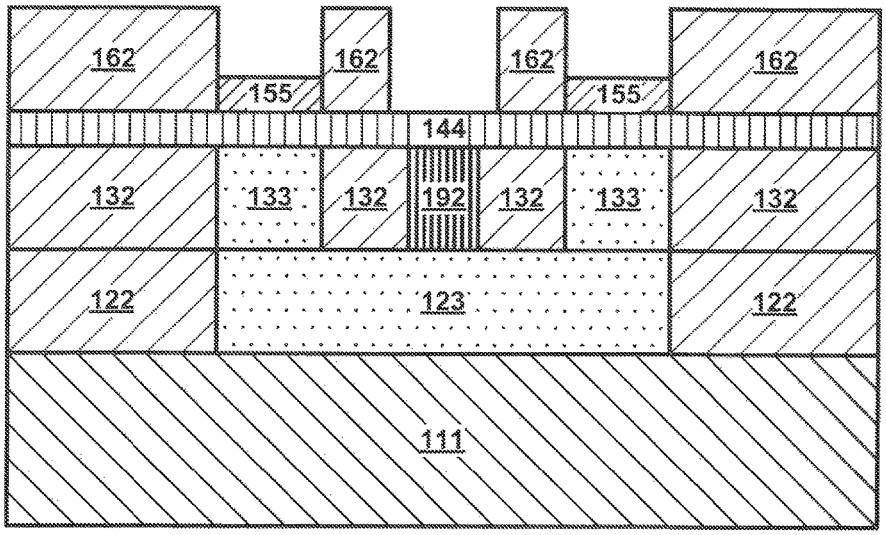
Figure 2D:
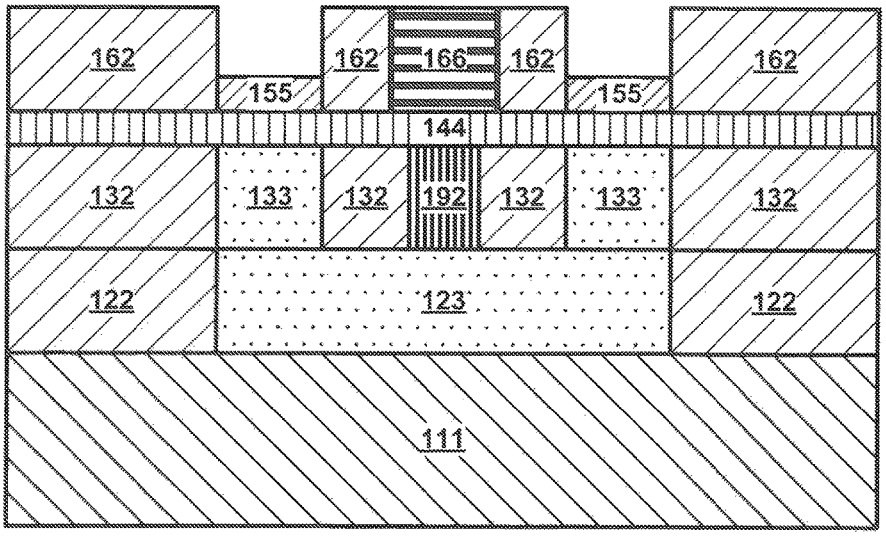
Figure 2E:
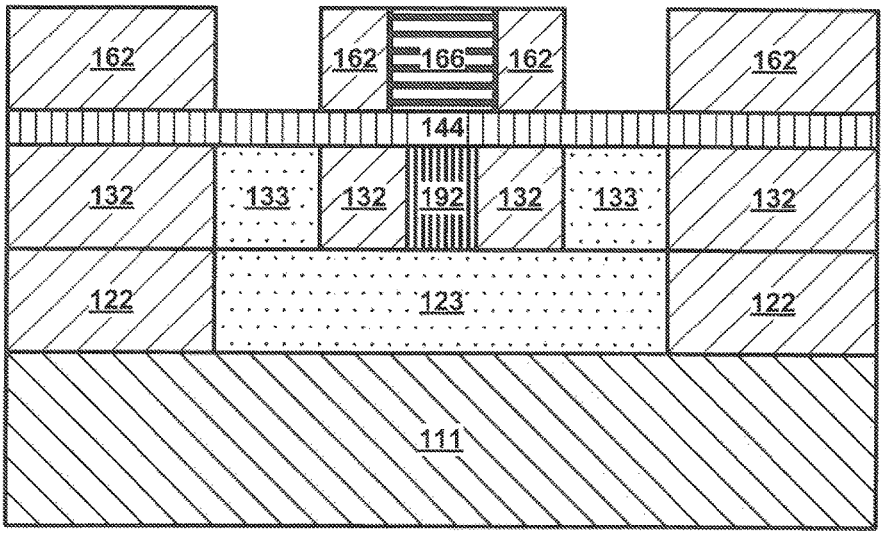
Figure 2F:
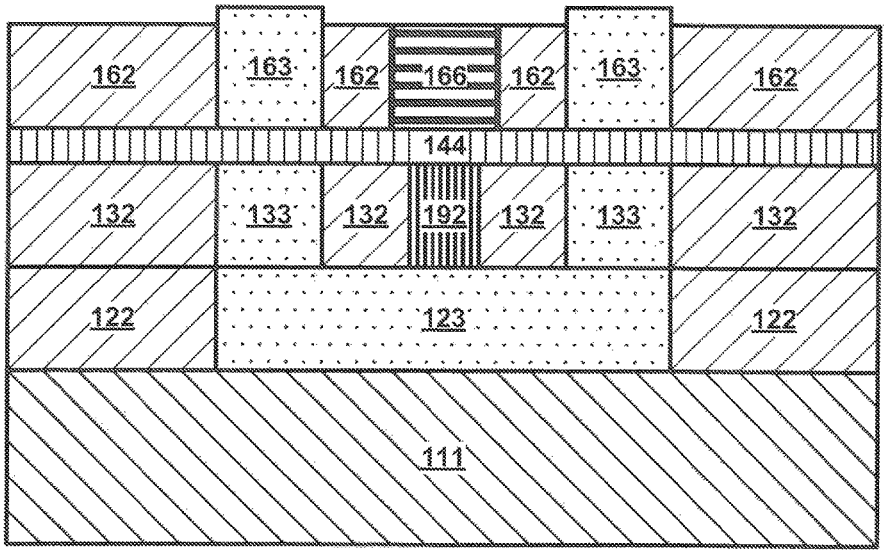
Figure 2G:
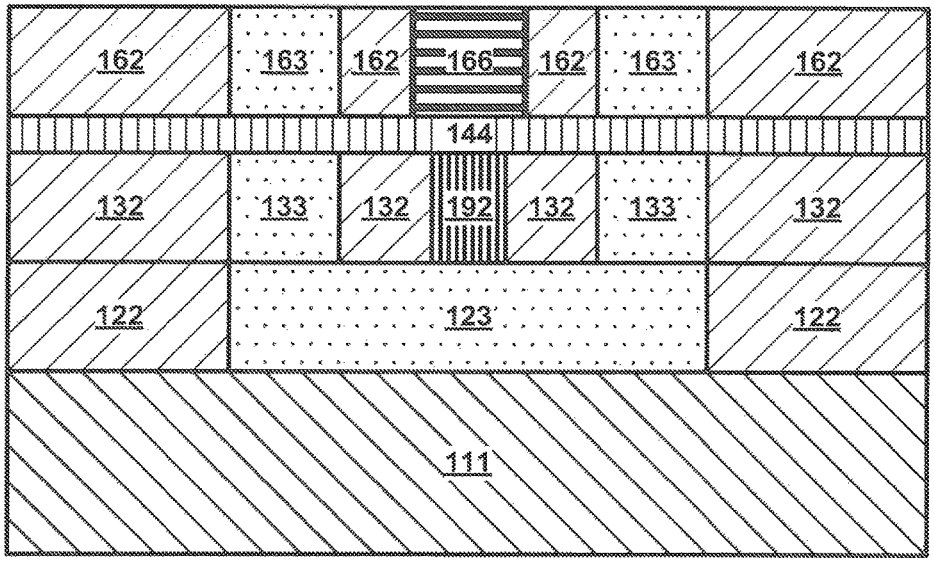
Figure 2H:
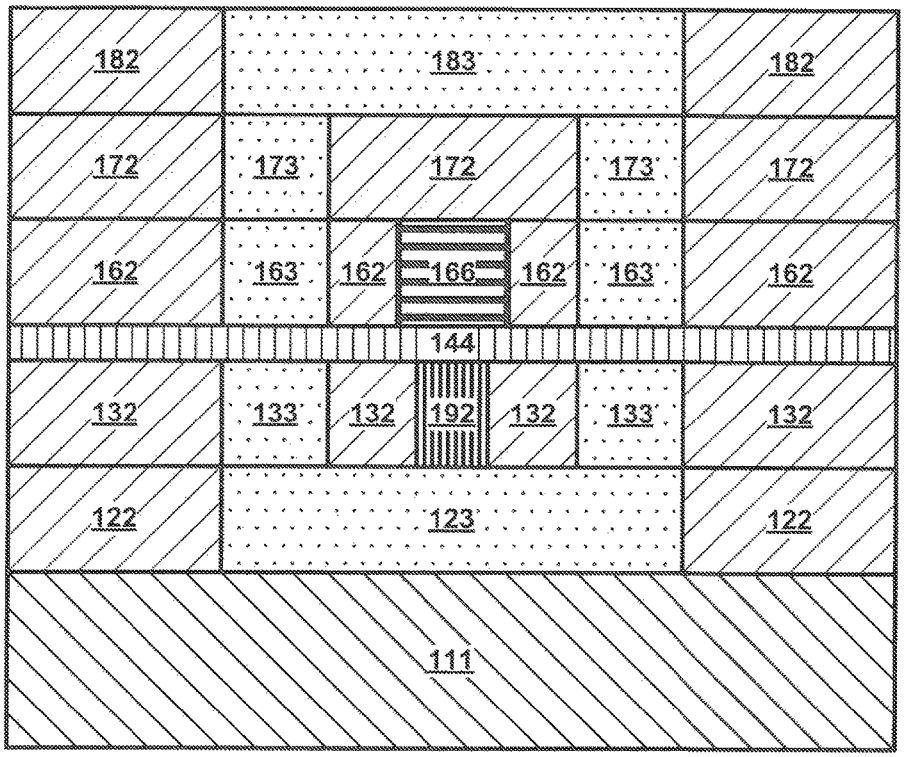

Referring to example FIG. 2A to FIG. 2H, a multi-layer build processes is illustrated in accordance with one aspect of embodiments. In embodiments, the order of formation of a first material and a second material may be determined, in part, by the configuration of the image-wise masking material. In embodiments, for example in the process illustrated in FIG. 2A to FIG. 2H, the first material formed may be material 166, as illustrated in FIG. 2D, and the second material formed may be material 163, as illustrated in FIG. 2F. In embodiments, the order of formation of first material 166 and second material 163 may be determined, in part, by the configuration of the seed layer, the passivation layer and/or the image-wise masking layer. In embodiments, one or more layers of the multi-layer structure may be planarized as illustrated in FIG. 2G. In embodiments, the first and the second material 166, 163 may be different from each other.

Figure 3A:
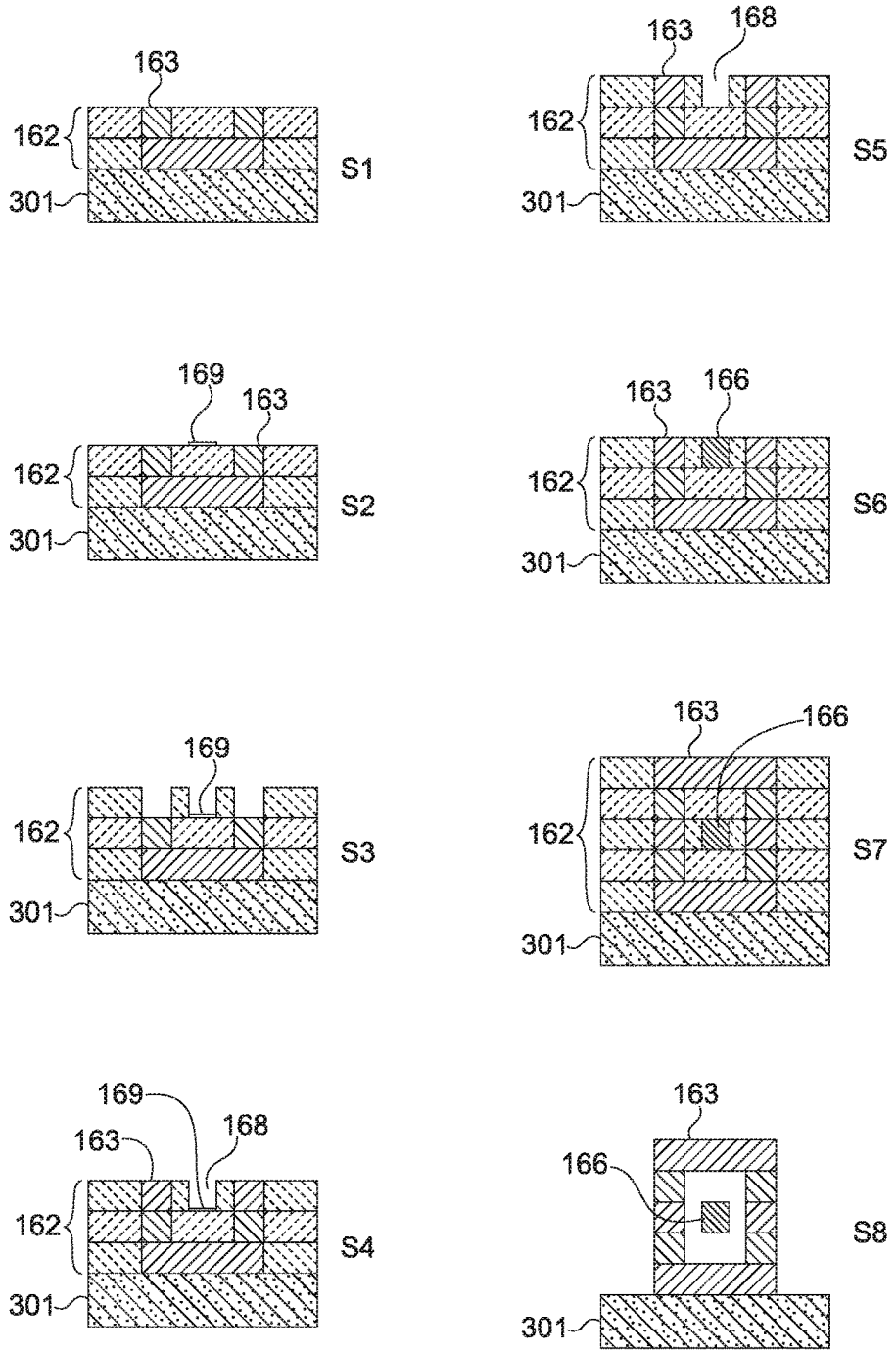
Figure 3B:
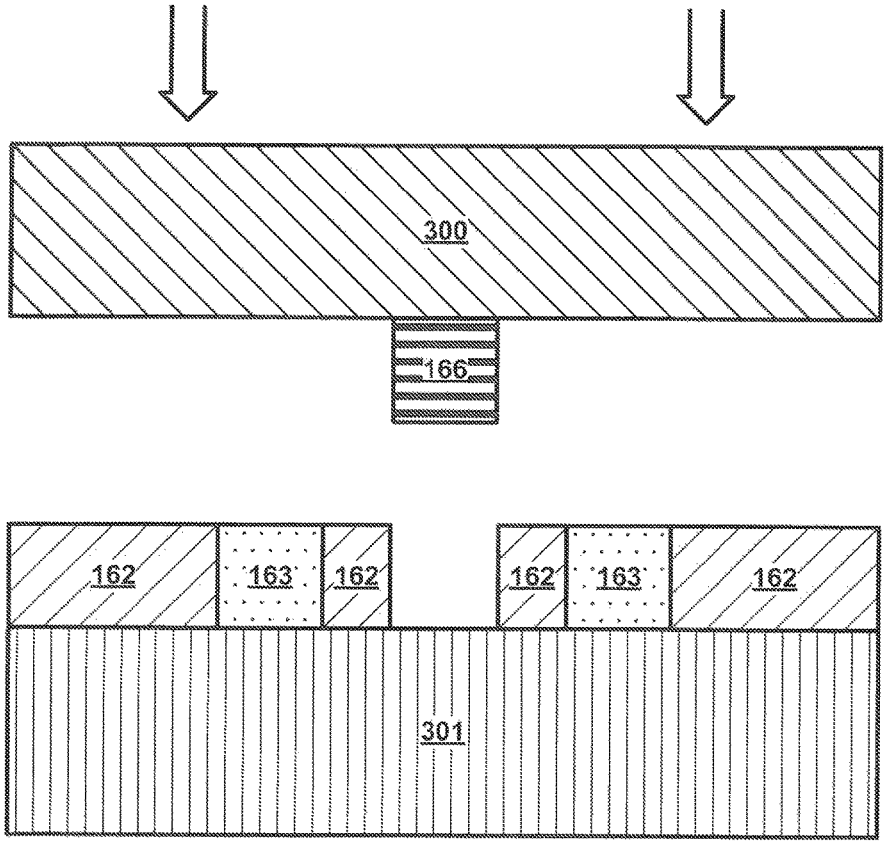
Figure 3C:
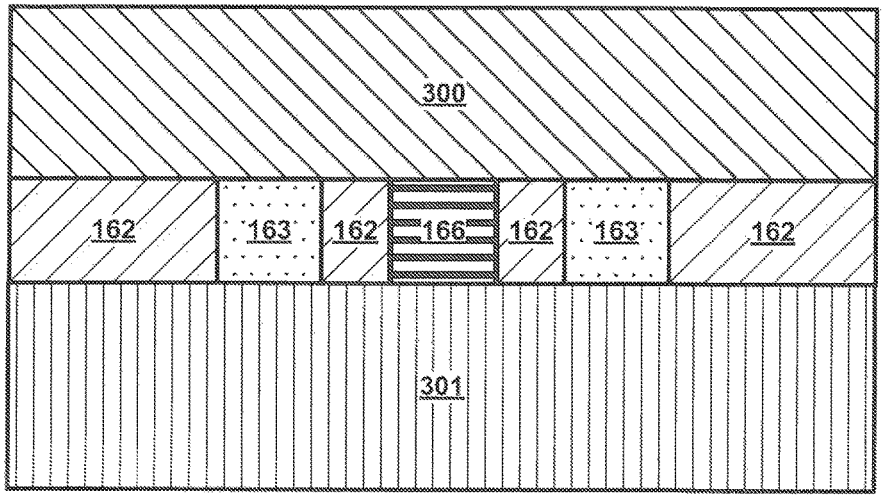
Figure 3D:
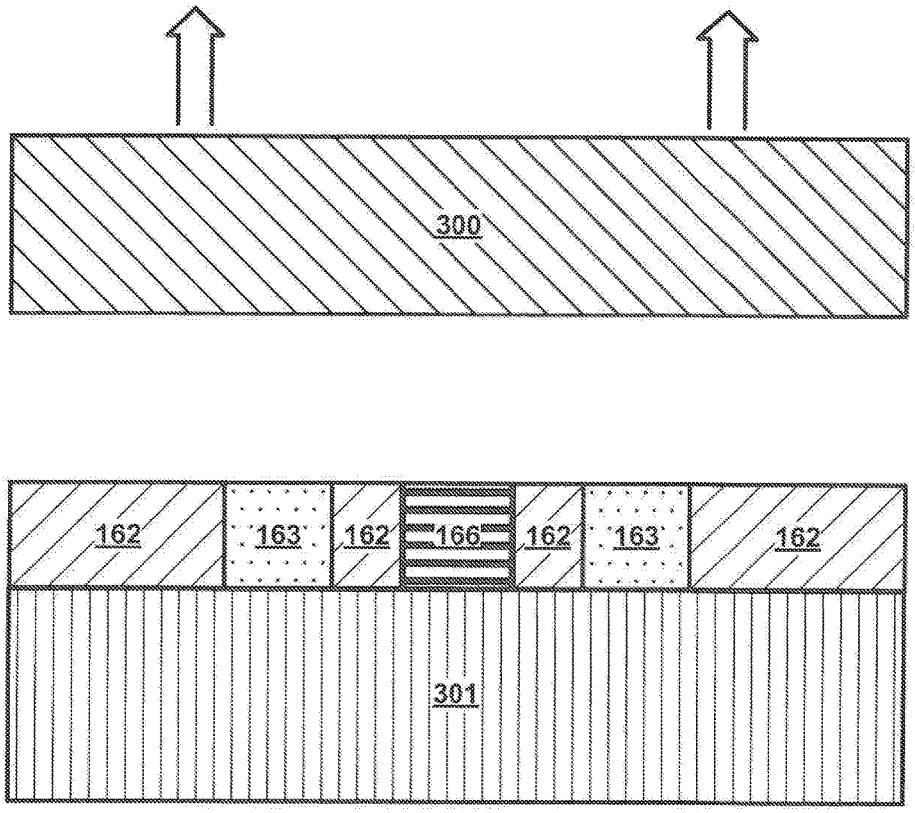

Referring to FIGS. 3A-3D, a multi-layer build processes is illustrated in accordance with one aspect of embodiments. In embodiments, the order of formation of a first material and a second material may be determined, in part, by the process employed. In embodiments, a placing process may be employed to form a material in a multi-layer structure. FIG. 3A illustrates a process for heterogeneous materials (intra-layer metals and non-conductive materials) in a PolyStrata® process of the present invention. The process includes starting with a PolyStrata® build of two layers including dielectric 162 or copper 163 support for magnetic material, S1. Optionally, first mold layers 162 may include a permanent dielectric (SU-8, BCB, polyimide, etc.). A seed layer (not shown) may be added and patterned; next a passivation layer 169 may be added and patterned where selective deposition is to occur, S2. PolyStrata® resist may then be deposited and patterned, S3. Copper 163 may be electroformed where no passivation layer 169 exists and CMP planarized, S4. The passivation layer 169 may be dry-etched to remove it, S5. A magnetic material 166 (core, toroid, etc.) may be pick-and-placed into the pocket 168, S6. The remainder of the build process may be completed as normal as per the PolyStrata® technology, S7. The resist 162 and seed layers may be removed to reveal a copper-magnet-dielectric structure, S8. Step S6 is illustrated further in FIGS. 3B-3D. As illustrated in one aspect of embodiments in FIG. 3B, an image-wise mold layer including mold material 162 and/or metal material 163 may be formed on substrate 301. In embodiments, second material 166 may be selectively placed in the area exposed by the image-wise masking mold layer. In embodiments, material 166 may be affixed to carrier substrate 300 and then affixed (transfer-bonded) to the substrate layer 301, as illustrated in one aspect of embodiments in FIG. 3D. Referring to FIG. 3B, carrier substrate material 300 may be released. In embodiments, affixing the material may be accomplished by any suitable process, for example employing adhesive, heat and/or pressure. In embodiments, material 166 may be patterned before being transferred, and/or may be first transferred and then patterned. In embodiments, mold material 162 may be sacrificial material, such that it may be removed.

According to embodiments, any suitable process may be employed to place a material on and/or over a substrate. In embodiments, a lamination process may be employed. In embodiments, a material may be patterned before and/or after it is laminated to a substrate layer. In embodiments, a material may be supported by a support lattice, for example to suspend the first material before it is laminated, and then the first material that is laminated to the substrate layer. In embodiments, a material may be dispensed, for example in an area exposed by a image-wise mold layer. Therefore, processes which may be employed to form a material may include one or more of, for example, an electrodeposition process, a transfer bonding process, a dispensing process, a lamination process, a vapor deposition process, a screen printing process and/or a squeegee process.

Referring to example FIG. 5, a multi-layer build processes is illustrated in accordance with one aspect of embodiments. According to embodiments, a temporary patterned passivation layer may be selectively applied on and/or over a conductive substrate, 510. In embodiments, an image-wise mold layer may be selectively formed on/and or over the substrate to expose at least one conductive area, 520. In embodiments, a first material may be formed on and/or over one or more of the exposed areas, 530. In embodiments, the temporary patterned passivation layer may be removed, which may provide another conductive area, 540. In embodiments, a second material may be formed on/and or over the other conductive area, 550.

According to embodiments, a blocking material may be formed, for example on and/or over a conductive portion of a substrate layer to block formation of a material in a layer of a multi-layer structure. In embodiments, a blocking material may include ceramic material. In embodiments, a ceramic material may be preformed and inserted into one or more portions of an image-wise mold layer, for example prior to forming a first and/or a second material of the multi-layer structure.

Referring to example FIG. 6, a multi-layer build processes is illustrated in accordance with one aspect of embodiments. According to embodiments, an image-wise mold layer may be formed on a substrate layer exposing at least one portion of the substrate layer, 610. In embodiments, a first material may be selectively placed in one or more exposed portion of the substrate layer, 620. In embodiments, a second material over the substrate layer, 630. In embodiments, an image wise-mold layer may include sacrificial material, which may be removed, 640.

According to embodiments, selectively placing a material may include a lamination process. In embodiments, a material may be patterned before and/or after the material is laminated. In embodiments, placing may include a transfer bonding process, for example where a first material is supported by a support lattice to suspend the first material before it is laminated, and then the first material is laminated to the substrate layer. In embodiments, placing may include a dispensing process, wherein the first material is selectively dispensed. In embodiments, placing may include a pick-and-place process, and/or any other suitable process.

Embodiments relate to devices, for example formed by multi-layer build process, such as a PolyStrata® process, in accordance with aspects of embodiments. As illustrated in example FIG. 7, a MEMS-based inductor, with a thick electroplated copper spiral coil 340 sandwiched between two planar magnetic layers 310, 350 is provided. The device may include first non-conductive material 320, for example insulative or dielectric material, formed on first non-insulative material, for example magnetic material in the form of a top magnetic core 310, for instance. In embodiments, conductive material 340 exhibiting a pattern, for example a copper coil that forms a spiral inductor, may be placed and/or formed on a second non-conductive material 330 by any suitable process, for example electrodeposition, transfer bonding, pick-and-place, which may employ an image-wise masking layer, a seed layer and/or a passivation layer in accordance with embodiments. In embodiments, an image-wise masking layer may include sacrificial material, which may be removed at the end the multi-layer build process. A bottom magnetic core 350 may be provided below the second non-conductive material 330. In embodiments, a second non-conductive material 320 may be formed between conductive material 340 and second magnetic material 310.

Embodiments relate to devices, for example formed by multi-layer build process in accordance with aspects of embodiments. As illustrated in example FIG. 8, a device formed may include non-conductive material 410, for example insulative material/mechanical stop. In embodiments, first non-insulative material, in the form of high-conductivity windings 420, along with a magnetic core 430 disposed within the windings 420, may be formed on non-conductive material 410 by any suitable process, for example electrodeposition, transfer bonding, pick-and-place, which may employ an image-wise masking layer, a seed layer and/or a passivation layer in accordance with embodiments. In embodiments, an image-wise masking layer may include sacrificial material, which may be removed at the end the multi-layer build process. In embodiments, for example, the magnetic core 430 may include, for example, NiFe, and/or windings 420 may include conductive material, for example copper.

Example Electrodeposition and Hybrid Embodiments

According to embodiments, a first material and/or a second material which form a portion of a multilayer structure may be electrodeposited in at least a part of the same layer of the structure. In embodiments, a first material, for example copper, may be electrodeposited in a layer of a multi-layered structure and a second material, for example NiFe, may be electrodeposited in the same layer as the copper. The first material and the second material may be adjacent and/or spaced apart from the second material in the same layer. In embodiments, pulse and/or reverse pulse plating techniques may be employed. In embodiments, a first material may be formed by an electrodeposition process and a second material be formed by a an electrodeposition process together with any other suitable process, for example a transfer bonding process, a pick-and-place process, a dispensing process and/or a lamination process in the same layer and/or a different layer of a multilayer structure.

According to embodiments, the first material and the second material may be processed, for example planarized, after electrodeposition. Planarization may be accomplished by a chemical-mechanical planarization (CMP) process after the conductive material and/or the magnetic material has been electrodeposited in accordance with one aspect of embodiments. Planarizing a magnetic material may substantially minimize problems associated with across-wafer thickness uniformity in accordance with one aspect of embodiments. In embodiments, a useful yield of relatively thick cores for magnetic micro-electrical-mechanical (MEMS) systems may be maximized. In embodiments, for example, CMP processes may works relatively well on copper, while CMP processes for NiFe and/or Ni may be relatively slow. In embodiments, CMP rates between approximately 0.5 micron per min and 5 micron per min may minimize uniformity issues associated with high speed plating. CMP may be employed to selectively stop at a layer that is not substantially polished in a chosen chemistry, for example to stop on a mold layer such as a photoresist. In embodiments, some or all materials in a layer may be planarized simultaneously through mechanical means such as lapping and/or polishing, fly cutting, surface grinding or diamond turning. In embodiments, such mechanical methods may maximize speed, depending on the materials, provide an ability to planarize materials that do not have CMP methods, and/or the ability to adjust multiple materials to a chosen thickness.

According to embodiments, one or more molds may be used to electrodeposit a first material and second material over selected portions of a substrate and/or an underlying layer of a multi-layer structure. In embodiments, a mold may include resist material. In embodiments, a relatively thin passivation layer may be formed on and/or over a substrate and/or a seed layer. In embodiments, a passivation layer may be selectively deposited and/or may be etched, such that an underlying layer may be exposed. In embodiments, the relatively thin passivation layer may be a patterned resist layer and/or a patterned dielectric layer, for example inorganic dielectric material.

According to embodiments, one or more molds may be formed over the substrate such that regions of a seed layer, passivation layer and/or conductive substrate layer may be exposed. In embodiments, portions of a seed layer and/or a conductive portion of a conductive substrate layer where the passivation layer exists will not be modified when a first material is electrodeposited, leaving one or more unfilled regions of the mold. A passivation layer may be removed, for example by plasma and/or chemical etching, and/or by selective stripping, after and/or before electrodepositing a first material in one aspect of embodiments. In embodiments, a second material may then be electrodeposited in the mold, providing two relatively thick electrodeposited layers of different materials located in at least a part of the same layer of the multilayer structure. In embodiments, planarization can then occur and to form two different materials in the same layer of the structure.

According to embodiments, a seed layer may be selectively deposited and/or etched to define where a first and/or second material is formed. In embodiments, a conductive substrate layer may include non-conductive material, such that a seed layer may be formed on and/or over one or more non-conductive portions. In embodiments, non-conductive portions of the conductive substrate layer may not be modified, leaving one or more unfilled regions of the mold. A first material may be electrodeposited over the exposed portions of the seed layer in accordance with one aspect of embodiments. In embodiments, a second material may be formed in the unfilled regions by any suitable process. In embodiments, where a second material is electrodeposited in one or more unfilled regions of a mold, a seed layer may be formed in the unfilled regions and then the second material may be electrodeposited in one or more portions of the mold. The first electrodeposited material may be passivated before the second electrodeposited material is formed, for example, to prevent deposition on the first material.

According to embodiments, a capping process may finish an electrodeposition step of a relatively high permeability material with copper to overfill a mold for CMP. In embodiments, a relatively high permeability material electrodeposition step may stop at between approximately 70% and 90% fill of a trench of a mold. In embodiments, copper may complete and/or overfill a resist mold for a layer. In embodiments, a CMP process may planarize each layer while allowing substantially all of the layers to be made of materials that may not be typically CMP processed with copper.

Magnetic MEMS Within PolyStrata® Embodiment

According to embodiments, in-plane and/or out of plane dimensional control across a wafer for films may be provided, where for example thickness uniformity would typically be problematic. In embodiments, relatively high force, high throw capability of micromagnetic elements with an array of multi-layer flexures and/or mechanisms may be provided. In embodiments, an addition of permanent dielectric may allow membranes, electrical isolation and/or floating elements within a build. In embodiments, introduction of a magnetic material may be used to create a second mechanical material. Copper itself may include desirable properties as a micro-mechanical material, including the ability to self-anneal at room temperature, between approximate 50 MPa and 70 MPa yield strength, approximately 117 MPa fatigue strength at approximately $10^8$ cycles, a Young's modulus of approximately 115 GPa, and/or residual stress of between approximately 10 MPa and 20 MPa. Most of these properties may be for annealed bulk, although plated thick films may approximate those numbers. This may give annealed copper a yield strength and Young's modulus not substantially different from nickel. Its use as a micromechanical material may not have been maximized and/or leveraged. In embodiments, any non-insulative material may be employed, for example Aluminum, Iron, Gold, Lead, Nickel, Silicon, Silver, Tantalum, Silver, Tin, Titanium, Tungsten and/or Zinc.

Example Transfer Bonding and Hybrid Embodiments

According to embodiments, a first material and/or a second material which may form a portion of a multilayer structure may be formed in at least a part of the same layer of the structure. In embodiments, a first material, for example magnetic material, may be transfer bonded in a layer of a multi-layered structure and a second material, for example Cu, may be formed in the same layer of the multi-layer structure as the copper material. In embodiments, the same material may be formed in the same layer. The first material and the second material may be adjacent and/or spaced apart from the second material in the same layer. In embodiments, a first material may be formed by a transfer bonding process and a second material be formed by any suitable process, including an electrodeposition process, a transfer bonding process, a pick-and-place process, a dispensing process and/or a lamination process in the same layer and/or a different layer of a multilayer structure.

Moreover, referring to FIG. 10, to incorporate relatively high quality magnetic materials 10 into a build process, steps S1-S5, a patterning process S3 may need to be compatible with materials and/or components 15 on a wafer 14 and/or materials may need to be pre-patterned and combined with our PolyStrata® wafer 14. Some magnetic materials 10 may require aggressive acids for etching at reasonable rates (for example involving nitric, HF, and/or sulfuric) and/or laser cutting, S3. These patterning operations S3 may not be compatible with on-wafer processing. Lamination may be a way to incorporate a variety of bulk processed magnetic materials. To maximize versatility in material patterning options, an example transfer bonding approach is illustrated in example FIG. 10.

While sufficiently thick layers may be held together with a support lattice, by using a handle wafer 12, a greater variety of layer thicknesses and/or patterning techniques may be leveraged without risk to a device wafer 14 (for example a PolyStrata wafer) in process. With this approach, materials 10 on and/or over the handle wafer 12 may be patterned by for example ion-milling, RIE, powder-blasting, chemical and/or electrochemical patterning, S3. A magnetic material 10 on and/or over a handle wafer 12 may be temporarily bonded, patterned, transfer bonded, and/or the handle released. This may open substantial material options.

In embodiments, transfer bonding may involve providing a material, for example a magnetic material, attached to a first carrier substrate to process, align and/or attach it to a device, for example a multi-layer structure, such as a PolyStrata® wafer. In embodiments, the material may be released from a carrier substrate, for example a handle wafer. In embodiments, the material may successfully bind to a device and/or substrate layer, for example a wafer. In embodiments, contamination may be minimized, for example from a handle adhesive. In embodiments, a material may be processed before and/or after it is transferred.

As to the transfer bonding and release, according to embodiments, a bonding material 11 may be provided for a carrier substrate 12 that may withstand a patterning processes S3, including materials that may endure etching chemicals, laser processing, and/or photopatterning materials. In embodiments, such material 11 may readily release parts 13 it holds, FIG. 10. In embodiments, bonding materials 11 may not transfer and/or may have to be removed from transferred materials, for example magnetic materials 13. In embodiments, the bonding material 11 may include 3M™ WSS and/or dry-film adhesive tapes such as Sekisui, Revalpha® and/or Rexpan. In embodiments, a variety of adhering and/or release mechanisms may be provided, for example maintaining relatively mild tack (WSS) in a film that relatively cleanly releases when a device is relatively more adhesively held, UV release adhesive, and/or thermal release adhesive, S2. The bonding material 11 may account for chemical compatibility of such materials with etchants for desired alloys. In embodiments, various approaches to bonding for wafer thinning applications, such as wafer bond HT by MicroChem, may be applicable. In embodiments, solvent release resins may be employed with bonding to a wafer, such as a PolyStrata® wafer, that may be coated in resist in accordance with one aspect of embodiments. In embodiments, UV and/or thermal release adhesive 11 may be employed.

In embodiments, a transferred material 13 may be etched, S3. In embodiments, laser cutting and/or powder blasting may be employed. In embodiments, for example when bulk material is removed, wet etching may be employed. In embodiments, rolls of material may be processed by wet etching techniques. In embodiments, Ni and/or Fe alloys may be etched in concentrated nitric and/or HCl, considering bonding material attack may be considered. In embodiments, Ferric chloride including a relative small quantity of HF may be employed, and/or may have a relatively mild effect on the adhesives 11.

According to embodiments, processes may account for the fact that etching methods, S3, may be isotropic in nature, which may make aspect ratio, minimum hole size, and/or sidewall profile further considerations. In embodiments, chemical etching may involve an isotropic undercut. In embodiments, double sided etching may be employed, and/or in a transfer bonding approach, both sides may need to be aligned in a double sided aligner and/or exposed to minimize back side alignment problems in metal. In embodiments, an etching process may be enhanced by employing electrochemical etching by making a work piece anodic in an etching bath. In embodiments, electrochemical machining (ECM) may enable greater than approximately 2:1 aspect ratios. In embodiments, leveraging ECM may include employing relatively milder etchants (including salts), which may provide greater compatibility with temporary bonding agents. In embodiments, ion milling and/or dry etching may be possible for relatively thin layers.

As to alignment of the magnetic material 13 to be transferred, according to embodiments, the magnetic material 13 may need to be aligned in a transfer bonding process, S4-S5. In embodiments, for example if a material is wafer-scale hybridly integrated, a material may be aligned and/or bonded to wafers taking into account run-out, planarity, CTE, dimensional accuracy and/or planarization. Lack of planarity may need to be addressed for transfer bonding. Each layer in a processed device wafer may produce variations in planarity due to film thickness variations across a wafer and/or bow/warp phenomena. Such variations may be introduced in a multi-layer thick resist process, for example as a result of accumulation of relatively small variations across the surface. In embodiments, such variations may be minimized such that components may be brought into intimate contact during a bonding process without substantially changing alignment and/or preventing intimate contact for bonding.

According to embodiments, to transfer bond magnetic materials 13, S5, an adhesion material may be provided. A material that may be compatible with, for example our PolyStrata® process, which may not substantially interfere with subsequent coil building may be included. In embodiments, a layer may include a temporary layer, such as a relatively thin layer of positive resist (e.g.: Shipley 1813), and/or thermally curable adhesive. In embodiments, such a layer may be spin-coated on and/or over a substrate 14 (e.g., a PolyStrata® wafer 14) between approximately 0.5 and 3 micron, and/or may be partially cured. In embodiments, components 13 may be aligned, tacked, and/or compression bonded allowing a transfer adhesive to cure, FIG. 10. In embodiments, for example after release of a substrate handle 10, resist and/or thermally curable adhesive material may be removed between gaps of transferred material 13 to allow metal, for example copper, to be re-exposed, for example to complete a coil construction. In embodiments, dry etching may be employed. In embodiments, negative resists such as SU-8 may be employed since they may not be substantially cross-linked by UV through materials, for example opaque magnetic materials 13. In embodiments, other processes which may be employed may include coating a material 13 to be transferred with an adhesive material through spray coating. In embodiments, enabling alignment and/or minimizing substantial "squeeze-out" during a compression thermal bonding process may be provided.

According to embodiments, minimizing bubbles from relatively thick resist processing, for example to build coils, may be provided. Transfer bonding of bulk parts may create voids with small pockets in, around and/or under elements. This may result from material finish, local height variation on a wafer, such as a PolyStrata® wafer, and/or imperfect adhesion. Baking a resist may cause gas expansion that forces air into materials during cure. In one example, due to a viscosity of materials, bubbles may become trapped and/or produce local thickness variations that may impact yield. In embodiments, precision transfer, proper tolerancing, and/or vacuum outgassing processes may be employed to minimize bubbles.

To continue a build sequence after a magnetic material 13 is bonded to a wafer 14, S5, for example a PolyStrata® wafer 14, a build may continue. According to embodiments, resist planarization processes may be employed to planarize one or more layers in a transfer bonding process. In embodiments, for example, resist may be planarization over the magnetic material topology. In embodiments, for example, 25 microns of strap material may be overcoated by 100 micron resist without substantial difficulty. Dielectric strap materials may be formed from photopatternable dielectrics. Such straps may be used to suspend or separate one or more materials in a build electrically and/or mechanically. Such approaches to suspend elements such as center conductors are illustrated in U.S. Pat. Nos. 7,012,489, 7,649,432 and/or 7,656,256.

According to embodiments, increasing thickness of a magnetic material 13 over an approximate 1:4 ratio may have impacts on resist coating and/or an ability to self-level. In embodiments, for example if spin-coating becomes problematic as a material thickness becomes an increasing fraction of a resist thickness (approximately 1:1), squeegee or doctor blade coating techniques may be used to apply mold or other materials to the build. Squeegee coating may minimize trapped air and maximize top surface clean-up, edge uniformity, and/or general process control. In embodiments, squeegee coating or doctor blade approach may enable forming resist thicknesses that are substantially level with magnetic material 13, and/or using magnetic material 13 as a hard stop for a squeegee. In embodiments, clean-up of residual resist may be accomplished employing CMP and/or lapping, and/or dry etching, for example where residual thickness of resist for clean-up is relatively small. In embodiments, transfer bonding elements may be provided into recesses left in a resist layer either before and/or after plating and/or planarization, for example in hybrid plating.

In addition, ferromagnetic materials may be electrically conductive, and accompanying electrical shorting may be minimized. In embodiments, passivation and/or electrical isolation processes may be deployed to ensure structures, such as coils may not be shorted. In embodiments, for example where conductive magnetic materials may be in contact with a coil, passivation materials such as spray coated, CVD, thermally deposited, sputtered and/or PECVD deposited dielectrics may be used. For example, paralene coatings and/or ALD coatings may be used. In embodiments, coatings may be chosen on their ability to minimize the magnetostrictive and/or other mechanical forces on the magnetic materials, and/or to prevent corrosion of the magnetic materials. Also, for example, forces from CTE mismatch between materials.

According to embodiments, stray eddy currents may be minimized. In embodiments, employing bulk foil ferromagnetic materials may allow maximized magnetic properties. This may be due to the inability for a multi-layer build to process bulk magnetic materials using the thermal and mechanical operations possible in bulk material processing. For example, in metglass, mu-metals, supermalloy and such materials high temperature processing may be incompatible with most multi-layer build processes and similar properties may be otherwise difficult to produce due to purity, grain size, crystal orientation, amorphous structures, etc. In embodiments, for example in AC applications (e.g., transformers, inductors, etc) many conductive ferromagnetic materials suffer from magnetic loop eddy current along a path of a primary loop flux that may produce a parasitic loss. In embodiments, loss may be minimized by incorporating electrical discontinuities and/or using relatively very thin layers. In embodiments, for example in transformers, magnetic loop losses may be addressed using laminated sheets that may have electrical discontinuities (E/I and/or C-cores). Thus, relatively small gaps may remain in place creating saturable cores and/or more than one complimentary layer may be laminated together, alternating gap locations and/or providing a continuous magnetic path but a discontinuous electrical path.

At relatively higher frequencies, eddy currents may appear within a thickness of a material, which may be addressed in one aspect of embodiments by employing relatively very thin ferromagnetic layers and/or by using ferrites. In embodiments, fabricating micro-laminate cores may be employ a transfer bonding process, repeatedly, to create a micro-magnetic laminate. For a microfabricated construction, E/I and/or C core constructions may be possible but moving to ferrite and/or other methods to deal with eddy current losses may be used due to processing complexity of incorporating thin, separately patterned, magnetic materials through a cost effective manner. If necessary, an approach to produce micro-laminate cores may be use a substantially similar transfer bonding approach discussed in this section repeatedly to create a micro-magnetic laminate. In embodiments, a relatively easy approach to E/I and/or C core construction may be to use relatively very thin ferromagnetic layers laminated together maximizing main loop electrical resistance while maximizing the frequency of operation for eddy currents within a thickness. In embodiments, foils of permalloy may be employed between approximately 5 micron and 13 micron layers. Using relatively thin layers bonding a laminate may be employed that may operate at MHz frequencies and/or may have minimal conductive losses which may extend a useable range of these materials. In embodiments, electroplating and/or sputtering between approximately 1 micron and 5 micron ferromagnetic layers with intervening dielectrics may be done on and/or over a handle wafer and transfer bonded, and/or performed using monolithic approaches. In some approaches, the effects of a lamination can be approximated by modulating the material properties during a deposition, for example, in reverse pulse plating the phosphorous content in Ni—P or Co—P can be modulated to interrupt the magnetic eddy currents.

Example Lamination and Hybrid Embodiments

According to embodiments, a first material and/or a second material which may form a portion of a multilayer structure may be formed in at least a part of the same layer of the structure. In embodiments, a first material, for example magnetic material, may be laminated to a substrate layer of a multi-layered structure and a second material, for example Cu, may be formed in the same layer of the multi-layer structure as the copper material. The first material and the second material may be adjacent and/or spaced apart from the second material in the same layer. In embodiments, a first material may be formed by a lamination process and a second material be formed by any suitable process, including an electrodeposition process, a transfer bonding process, a pick-and-place process, a dispensing process and/or a lamination process in the same layer and/or a different layer of a multilayer structure.

According to embodiments, a material, for example magnetic material, may be incorporated into a build process. In embodiments, direct lamination may be possible for deformable polymer films, and/or Al foils. In embodiments, a lamination process may include forming lead-frame sheets, for example where a substantially all elements are mechanically interconnected through a support lattice. In embodiments, this may allow a free-standing sheet of material that may be laminated and/or transfer bonded to a wafer, such as a PolyStrata® wafer. In embodiments, a support lattice may be removed during die separation. In embodiments, as previously discussed, spin-coating, bubble minimizing, dielectric coating, adhesion, and/or planarization processes may be employed in a lamination process. In embodiments, designs that may accommodate residual features of a support network, device packing density from a support lattice, and/or thicknesses that allow physical handling may be considered. Relative simplicity of a lamination process may be relatively high and/or dimensions may be attractive to a device design space.

Example Dispensing and Hybrid Embodiments

According to embodiments, a first material and/or a second material which may form a portion of a multilayer structure may be formed in at least a part of the same layer of the structure. In embodiments, a first material, for example non-conductive material, may be dispensed in a layer of a multi-layered structure and a second material, for example Cu, may be formed in the same layer of the multi-layer structure as the copper material. The first material and the second material may be adjacent and/or spaced apart from the second material in the same layer. In embodiments, a first material may be formed by a transfer bonding process and a second material be formed by any suitable process, including an electrodeposition process, a transfer bonding process, a pick-and-place process, a dispensing process and/or a lamination process in the same layer and/or a different layer of a multilayer structure.

According to embodiments, increasing thickness of a magnetic material over an approximate 1:4 ratio may have impacts on resist coating and/or an ability to self-level. In embodiments, for example if spin-coating becomes problematic as a magnetic material thickness becomes an increasing fraction of a resist thickness (approximately 1:1), squeegee coating may be used. Squeegee coating may minimize trapped air and maximize top surface clean-up, edge uniformity, and/or general process control. In embodiments, squeegee coating may enable forming resist thicknesses that are substantially level with magnetic material, and/or using magnetic material as a hard stop for a squeegee. In embodiments, clean-up of residual resist may be accomplished employing CMP and/or lapping, and/or dry etching, for example where residual thickness of resist for clean-up is relatively small. In embodiments, transfer bonding elements may be provided into recesses left in a resist layer either before and/or after plating and/or planarization, for example in hybrid plating.

Example Pick-and-Place and Hybrid Embodiments

According to embodiments, non-conductive materials and/or preformed shapes may be pick-and-place mounted into one or more layers of a multi-layer PolyStrata® structure, for example mid build. In embodiments, Ferrites, for example, may be a material employed in relatively high frequency operation of magnetic devices, or in non-reciprocal microwave devices such as circulators, isolators, or phase shifters. In embodiments, for example where ferrite materials are employed, a sintering process may occur between approximately 900 degrees C. to 1300 degrees C. In embodiments, while thin films may be produced, thicker materials with bulk properties may be incorporated using a process that fills holes and/or pockets in a resist, is bonded on and/or over a surface with mold, and/or is a laser-cut ferrite element. In embodiments, a relatively thin ferrite material may be used having a thickness substantially similar to the maximum thickness of a resist. In embodiments, bulk density properties may be attained. In embodiments, the serial nature of a pick-and-place operation, matching thicknesses between parts and/or films, and/or bubbles in a resist due to an imperfect fit may be accounted for. In embodiments, a pick-and-place operation may be readily automated. An example process flow for this method of hybrid integration is shown in example FIGS. 3A-3D.

Example Slurry/Composite Dispense and/or Squeegee Transfer

Slurry/composite dispense and/or squeegee transfer into and/or onto a substrate, including a PolyStrata® wafer, for EMI shielding and/or to create cores post-release and/or intra-build, may be an important capability for some applications. Relatively high % (for example between approximately 50% and 60%) solids fill for nano-crystalline ferrite materials may be used with binders and/or epoxies to overcoat released coils for EMI shielding, to fill released coils for a core material, and/or may be dispensed into pockets similar to a pick and place approach using a squeegee. A process to fill resist pockets intra-build to create inductor and/or toroid cores may be provided.

Example Dual Material Electroplating and CMP (for Example Within a Strata)

One of the interesting approaches to monolithic integration is to enable both copper and/or a magnetic material to be processed in a single layer and/or planarized using a CMP process. The ability to planarize a plated magnetic material may substantially eliminate problems with across-wafer thickness uniformity, which may limit a useful yield in relatively thick cores for magnetic MEMS. NiFe, NiCo and/or other magnetic alloys, plating solutions, and/or plating cells for aligned domain films may be applied. Electroplating and/or planarization of magnetic materials in a strata as copper conductors may be provided. A plating step including well controlled electrodeposited magnetic materials may be provided.

CMP process works relatively well on copper. While CMP for NiFe and/or Ni may be demonstrated for thin films, the processes may be relatively slow. Rates between approximately 0.5 micron per min and 5 micron per min may be attractive for relatively thicker core materials to address uniformity issues associated with high speed plating. These CMP chemistries may be compatible with a PolyStrata resist. Embodiments may include the following, as illustrated in example FIG. 11. The process may include starting with a PolyStrata® build on a substrate 701 of two layers including dielectric 702 or copper 703 support for magnetic material, S1. A seed layer 704 may be added and patterned, and a passivation layer may be added and patterned where selective deposition is to occur, S2. PolyStrata® resist 702 may then be deposited and patterned, S3. A magnetic material 766 (NiFe) may be electroformed where no passivation layer exists and CMP planarized ($KMnO_3$ based chemistry is contemplated), S4. The passivation layer may be removed by dry-etching; optionally, the NiFe may be passivated with positive resist to stop copper plating to minimize overplate, S5. Copper 703 may be electroformed, S6, and CMP planarized, S7. The remainder of the build process may be completed as normal as per the PolyStrata® technology, S8. The resist 702 and seed layers may be removed to reveal a copper-NiFe-dielectric structure, S9.

Features of the process/device of FIG. 11 include the following:

a. A relatively thin, patternable, selectively removable seed-layer masking material may allow regions of electroplating seed layers to be temporarily masked to substantially prevent plating on and/or over certain regions. This material may be a patterned dielectric such as a third resist for the system and/or a patterned inorganic dielectric.

b. A plating bath may create a high permeability magnetic core material that may be integrated into a build. NiFe and/or CoFe may meet needs and/or ensure chemically compatible with our processing technology. Materials may be characterized by VSM. Pulse and/or reverse pulse plating techniques may be deployed as needed.

c. A novel copper capping process may finish an electroforming step of a high permeability material with copper to overfill a resist mold for CMP. A high permeability material electroforming may stop at between approximately 70% and 90% fill of a trench and/or copper may complete and/or overfill a resist mold for that layer. This may allow an existing CMP process to planarize each layer while allowing substantially all of the layer to be made of materials that may not be CMP processed with copper.

d. A CMP process may directly planarize a magnetic material. A rate and/or chemical compatibility with copper may be considered. This process may be done in conjunction with a copper capping process.

Example Device Embodiments

According to embodiments, devices including a first material and a second material at the same layer of a multilayer structure may be fabricated. According to embodiments, devices including a multi-layer structure having components manufactured by one or more of an electrodeposition process, a transfer bonding process, a pick-and-place process, a dispensing process and/or a lamination process may be provided. In embodiments, a material, for example an active and/or passive electrical device, may be placed.

Devices manufactured in accordance with one aspect of embodiments, such as by a PolyStrata® 3D metal MEMS architecture of the present invention, may include structures such as inductors (including air-coil inductors), transformers, springs, and/or coils, microactuators where the actuation distance and/or force is maximized, sensors such as magnetic field and/or inductive sensors, micro-engines and/or micro-generators, and or microfluidic devices. Devices manufactured, e.g., by a PolyStrata® magnetic MEMS approach, may include close-to-true toroidal structures, and/or integrate them on and/or over a module, providing for approximately 10× better performance and/or 3-D integration with other devices to fabricate, for example, inductors, transformers, and/or electromagnetic actuators. In embodiments, conductive material, air, dielectrics and/or magnetic material may be provided in one or more layers, enabling for example working coils on and/or over magnetic coils. In embodiments, devices manufactured may include maximized force, throw and/or power. In embodiments, design versatility if maximized, for example providing metal crossovers suspended over other layers, to provide predetermined shapes desired.

As to inductors of the present invention, inductance values may be less than 3 nH, although larger inductance values with relatively lower self resonant frequencies may be possible. Inductors that that may be fabricated may be suitable for integration in lumped-element filters and/or RF chokes in bias networks for active devices operating at frequencies for example between approximately 1 GHz and 20 GHz. Inductor characterization may be done by measuring a two-port network, where an inductor may be in series with a 50-ohm transmission line. Example FIGS. 9A-9C shows measured (FIG. 9A) and/or simulated parameters (FIG. 9C) for three-turn inductors in accordance with the present invention (FIG. 9B). A thru-reflect-line calibration may be performed to de-embed S-parameters to where an inductor meets a transmission line. The quality factor (Q factor) may be estimated as $Q=\omega L/R$, where R is the resistance of an inductor. For example, the double three-turn inductor shown in example FIG. 9B may have values of L=3.0 nH, freq=10.75 GHz, R=0.5 W, Q=46 (at 1 GHz). Processes of the present invention process may be used to fabricate intricate windings, coils, mechanical structures, and/or flexures with integrated magnetic materials to enable magnetic-MEMS-based devices on a scale of integration not currently available.

As further example of a type of device that may be made by the processes disclosed herein, FIGS. 12A-12B illustrate a microvalve. Indeed, microactuators form a broad field of product applications ranging from speakers for hearing aids to relays to valves may be produced. Microvalves may be useful to future innovations in energy (for example, fuel cell), medical, in-vitro diagnostic, and/or chemistry fields. Microfluidic products may no longer be limited to passive fluid control mechanisms such as capillary forces. Such devices may be useful in industries which may be demanding an ability to automate portable medical devices, micro fuel cells, and/or miniature reactors. Wafer-level magnetic MEMS components of the present invention may promote automation throughout microfluidic systems through these readily integrated devices. In addition, magnetic field sensors may be made by the processes disclosed herein, and may have been widely used in the automotive market for steering speed detection for ABS systems and/or new electronic stability program (ESP). These sensors may also be used in medical devices (for example, pacemakers), and/or as compasses in navigational systems. Magnetic MEMS technology of the present invention may also play a role in the inductive sensor market, where piezomagnetic materials may sometimes used instead of piezoelectric materials in applications such as pressure sensors and/or strain gauges. Performance for a given application may dictate the choice for a magnetic solution. These may be relatively higher forces over greater deflections, as is useful in actuators and/or relays.

In embodiments, devices manufactured may include microactuators which may be applied to a variety of fields, including speakers for hearing aids and relays to valves. In embodiments, devices manufactured may include microvalves which may be applied in energy application, for example fuel cell application, medical applications, in-vitro diagnostic applications, and/or chemical fields. In embodiments, devices manufactured may include microfluidic products which may no longer be limited to passive fluid control mechanisms such as capillary forces. In embodiments, such devices may be useful in fields which demand an ability to automate portable medical devices, micro fuel cells, and/or miniature reactors.

In embodiments, devices manufactured may include magnetic field sensors, for example for use in the automotive market for steering speed detection for ABS systems, and/or new electronic stability program (ESP). In embodiments, such sensors may be used in medical devices, for example, pacemakers and/or navigational systems. In embodiments, devices manufactured may include inductive sensors, where piezomagnetic materials may be used instead of or in addition to piezoelectric materials in applications such as pressure sensors and/or strain gauges. In embodiments, performance for a given application may dictate the choice for material, for example for a magnetic solution. In embodiments, such parameters may include relatively higher forces over greater deflections, as is useful in actuators and/or relays.

According to embodiments, using multilayer structures in accordance with embodiments may relate to energy harvesting and/or power generation at a micro scale. In embodiments, integrating micro-engines with micro-generators for battery replacement applications may be provided. In embodiments, since hydrocarbon fuels may supply approximately 300 times more energy per unit weight than a NiCad battery and/or approximately 100 times more than a Li-ion battery, a micro-engine may have the potential to release the energy from the fuels and/or possibly replace batteries in portable devices. FIGS. 14A, 14B show such an integrated micro-engine concept—developed for soldier portable power applications. Powering such a device would be a disposable fuel canister that could last much longer than traditional batteries and allow greater range of soldier mobility.

In embodiments, relatively high Q's, high thermal conductivity, precision placement of coils and/or other components, and/or 3-D topology may be provided by the PolyStrata® magnetic MEMS of the present invention, for example. In embodiments, architecture and/or design rules may be used to commercialize technology in accordance with one aspect of embodiments, for example by producing customized magnetic MEMS components and/or modules.

In embodiments, incorporation of ferrites may be used to make non-reciprocal microwave devices such as circulators, isolators, and phase shifters. In embodiments, active devices such as SiGe, GaN, Si, CMOS, InP and integrated or discrete devices may be embedded and may also be interconnected to other metal or dielectric structures or have electrical and thermal interconnects grown upon or to them using techniques taught in this art. Devices such a transistors, amplifiers, capacitors, resistors, lasers, detectors, mixers, signal processors, and control circuits, for example, may be pick and place integrated and/or embedded into a multi-layer build using the techniques described in this art. For example, a baseline magnetic MEMS capability with a PolyStrata® coil build around magnetic core characterizing parameters of a magnetic material and/or coil properties may be provided. Embodiments of the present invention may include: chemical and/or electrochemical etching of magnetic materials; NiFe electroplating, CMP and/or characterization; pick and place of magnetic material into a substrate, including a PolyStrata® wafer; transfer bonding into a substrate, including a PolyStrata® wafer; coils over magnetic cores; characterization of cores with coils and/or embodiment devices, including actuators; measurement such as, an LF-impedance analyzer for coil testing, vibrating sample magnetometer, SEM, AFM, TEM methods for material characterization; a PolyStrata® wafer example comprising a) Build wafers including lower half of coils for transfer bonding, b) Processing to allow pockets for pick and place, c) Processing to allow pockets with removable passivation for mixed plating, and d) air-core coils for testing and/or for ferrite slurry fill/coating; transfer bonding methods, comprising pattern magnetic materials on and/or over a handle wafer, and/or transfer bond them to an in-process PolyStrata wafer for continued processing; material patterning methods for magnetic foils and/or sheets, comprising etching, electrochemical etching, and/or powder blasting; NiFe capable process, such as a) NiFe plater; b) specialty plating; c) CMP for Ni and/or NiFe; pick and place methods; develop and test composite dispense methods; complete coil constructions (for example continue PolyStrata® build) once magnetic materials are inserted, and/or continued processing for each with repeated iterations; and providing test structures and/or characterize performance.

It will be obvious and apparent to those skilled in the art that various modifications and variations can be made in the embodiments disclosed. Thus, it is intended that the disclosed embodiments cover the obvious and apparent modifications and variations, provided that they are within the scope of the appended claims and their equivalents.

What is claimed is:

1. A method of forming a three-dimensional multilayer electromagnetic microdevice by a sequential build process, comprising:

depositing a plurality of layers over a substrate, wherein the layers comprise one or more of a conductive material and a sacrificial material thereby forming a multilayer microstructure above the substrate, the microstructure having one or more walls comprised of a plurality of layers of the conductive material, the walls defining at least one cavity in a top layer of the multilayer microstructure furthest from the substrate, the at least one cavity having the sacrificial disposed therein;

removing the sacrificial material from the at least one cavity and thereafter providing a magnetic microstructural element comprising a magnetic material within the at least one cavity; and thereafter continuing the build process by depositing a plurality of layers of the conductive and sacrificial materials over the top layer and the magnetic material to provide the multilayer electromagnetic microdevice.

2. The method of forming a three-dimensional microstructure according to claim 1, wherein the at least one cavity in the top layer includes a plurality of cavities in the top layer, and wherein a selected cavity includes a material different from the magnetic material.

3. The method of forming a three-dimensional microstructure according to claim 2, wherein material in the selected cavity comprises a metal.

4. The method of forming a three-dimensional microstructure according to claim 1, wherein the sacrificial material comprises a dielectric material.

5. The method of forming a three-dimensional microstructure according to claim 1, wherein the sacrificial material comprises an insulative material.

6. The method of forming a three-dimensional microstructure according to claim 1, wherein the walls comprise windings.

7. The method of forming a three-dimensional microstructure according to claim 1, wherein the magnetic material comprises one or more of nickel iron and cobalt iron.

8. The method of forming a three-dimensional microstructure according to claim 1, wherein the multilayer electromagnetic microdevice comprises a multi-turn inductor.

9. The method of forming a three-dimensional microstructure according to claim 1, wherein the multilayer electromagnetic microdevice comprises a double multi-turn inductor.

10. The method of forming a three-dimensional microstructure according to claim 1, wherein the step of disposing a plurality of layers comprises providing a seed layer and selectively applying a patterned passivation layer over the seed layer to expose a first portion of the seed layer and to block a second portion of the seed layer.

11. The method of forming a three-dimensional microstructure according to claim 10, comprising selectively removing the exposed first portion of the seed layer.

12. The method of forming a three-dimensional microstructure according to claim 1, wherein for a selected layer strata, the layers of sacrificial and conductive materials within the strata have the same height in a direction normal to the selected layer.

13. The method of forming a three-dimensional microstructure according to claim 1, wherein the magnetic material comprises a ferrite.

14. The method of forming a three-dimensional microstructure according to claim 1, wherein the walls comprise a plurality of windings disposed in spaced apart relation to define a winding cavity, and wherein the magnetic material comprises a magnetic core that extends through the winding cavity.

15. The method of forming a three-dimensional microstructure according to claim 1, wherein a selected layer comprises a metal, a magnetic material, and a non-magnetic material.

16. The method of forming a three-dimensional microstructure according to claim 1, wherein a selected layer comprises at least a portion of the cavity and two or more different conductive materials.

17. The method of forming a three-dimensional microstructure according to claim 1, comprising removing the sacrificial material after the step of continuing the build process.

18. The method of forming a three-dimensional microstructure according to claim 1, wherein the multilayer electromagnetic microdevice comprises a non-reciprocal microwave device.

19. The method of forming a three-dimensional microstructure according to claim 18, wherein the non-reciprocal microwave device is one or more of a circulator, an isolator, and a phase shifter.

20. The method of forming a three-dimensional microstructure according to claim 1, comprising providing on the substrate an active device operably connected to the multilayer electromagnetic microdevice.

* * * * *